US008683802B2

(12) United States Patent
Cohen

(10) Patent No.: US 8,683,802 B2
(45) Date of Patent: Apr. 1, 2014

(54) INSTALLATION DESIGNED TO CONVERT ENVIRONMENTAL THERMAL ENERGY INTO USEFUL ENERGY

(76) Inventor: Yoav Cohen, Vessy (CH)

( * ) Notice: Subject to any disclaimer, the term of this patent is extended or adjusted under 35 U.S.C. 154(b) by 144 days.

(21) Appl. No.: 13/256,343

(22) PCT Filed: Feb. 18, 2010

(86) PCT No.: PCT/EP2010/052027

§ 371 (c)(1),
(2), (4) Date: Sep. 13, 2011

(87) PCT Pub. No.: WO2010/115654

PCT Pub. Date: Oct. 14, 2010

(65) Prior Publication Data

US 2012/0017593 A1 Jan. 26, 2012

(30) Foreign Application Priority Data

Apr. 8, 2009 (EP) ..... 09157592

(51) Int. Cl.
*F01K 13/00* (2006.01)

(52) U.S. Cl.
USPC ..... 60/643; 60/645

(58) Field of Classification Search
USPC ..... 60/645, 643, 325; 136/201, 224
See application file for complete search history.

(56) References Cited

U.S. PATENT DOCUMENTS

| | | | | |
|---|---|---|---|---|
| 3,919,845 A | | 11/1975 | Eskeli | |
| 4,017,755 A | * | 4/1977 | Litz | 310/40 R |
| 6,681,576 B1 | * | 1/2004 | Abe | 60/643 |

FOREIGN PATENT DOCUMENTS

| | | | | |
|---|---|---|---|---|
| DE | 27 51 530 A | | 5/1979 | |
| WO | WO 2008/068491 A | | 6/2008 | |
| WO | WO 2008068491 A2 | * | 6/2008 | F01K 21/00 |

* cited by examiner

*Primary Examiner* — Kenneth Bomberg
*Assistant Examiner* — Deming Wan
(74) *Attorney, Agent, or Firm* — Frommer Lawrence & Haug LLP; Ronald R. Santucci

(57) ABSTRACT

The present invention relates to an installation and a process implementing the installation for converting thermal energy available in a given environment into useful energy. The installation and process use pressure differentials between a hot and a cold column of a pressurized fluid to create a continuous flow in a fluid. The flow drives in rotation elements the rotational energy of which is converted to a useful energy.

11 Claims, 7 Drawing Sheets

INSTALLATION DESIGNED TO CONVERT ENVIRONMENTAL THERMAL ENERGY INTO USEFUL ENERGY

This application is a 371 of PCT/EP2010/052027 filed on Feb. 18, 2010, published on Oct. 14, 2010 under publication number WO 2010/115654 A, which claims priority benefits to European Patent Application 09157592.8, the entire disclosure of which is incorporated herein by reference.

The present invention relates to an installation designed to convert thermal energy available in a given environment into useful energy. The invention relates also to a process implementing such an installation for converting thermal energy available in a given environment into useful energy.

The installation according the present invention is defined in claim 1. Other embodiments are defined in claims 2 to 4.

The process implementing the installation according the present invention is defined in claims 5 to 8.

As will be shown, the process and installation use pressurized fluid in its cavities as agent to receive thermal energy from a surrounding environment and pass it on to be converted to useful forms. The fluid, placed in centrifuge conditions, is in gas state at least for the portion of the process by which it passes on—part of its stored energy—outward for transformation and beneficial use.

In each cycle, cycle being the process by which a portion of the system's fluid of mass m, passes through the whole system's designated flow path to get back to its original position, at the beginning of the cycle, the fluid gets cooled by the loss of energy output, doing work outside of the system and reheated by receiving heat from the surrounding environment causing the cooling of the environment.

The process and installation may be of dimensions and energy production level ranging from very small to very large thus widening the circumstances and variety of uses. In addition the process and installation may be configured in many ways to be adopted for each particular chosen use.

For this reason, the materials, structure, dimensions, components and configuration presented in this application are representative of the requirements necessary to make the process and installation work, rather than absolute choice. The details are by way of example to provide sufficient substance presenting the validity of the practical process and installation.

The installation and the process invention will be described in more details with reference to attached drawings FIG. 1 is a cross axial section view of the inner rotor of a first embodiment of the present invention;

The installation is made of three main elements:

Inner rotor, hereafter referred to also as IR

Outer shell, with/without additional casing, hereafter also referred to as OS

Figure 1:
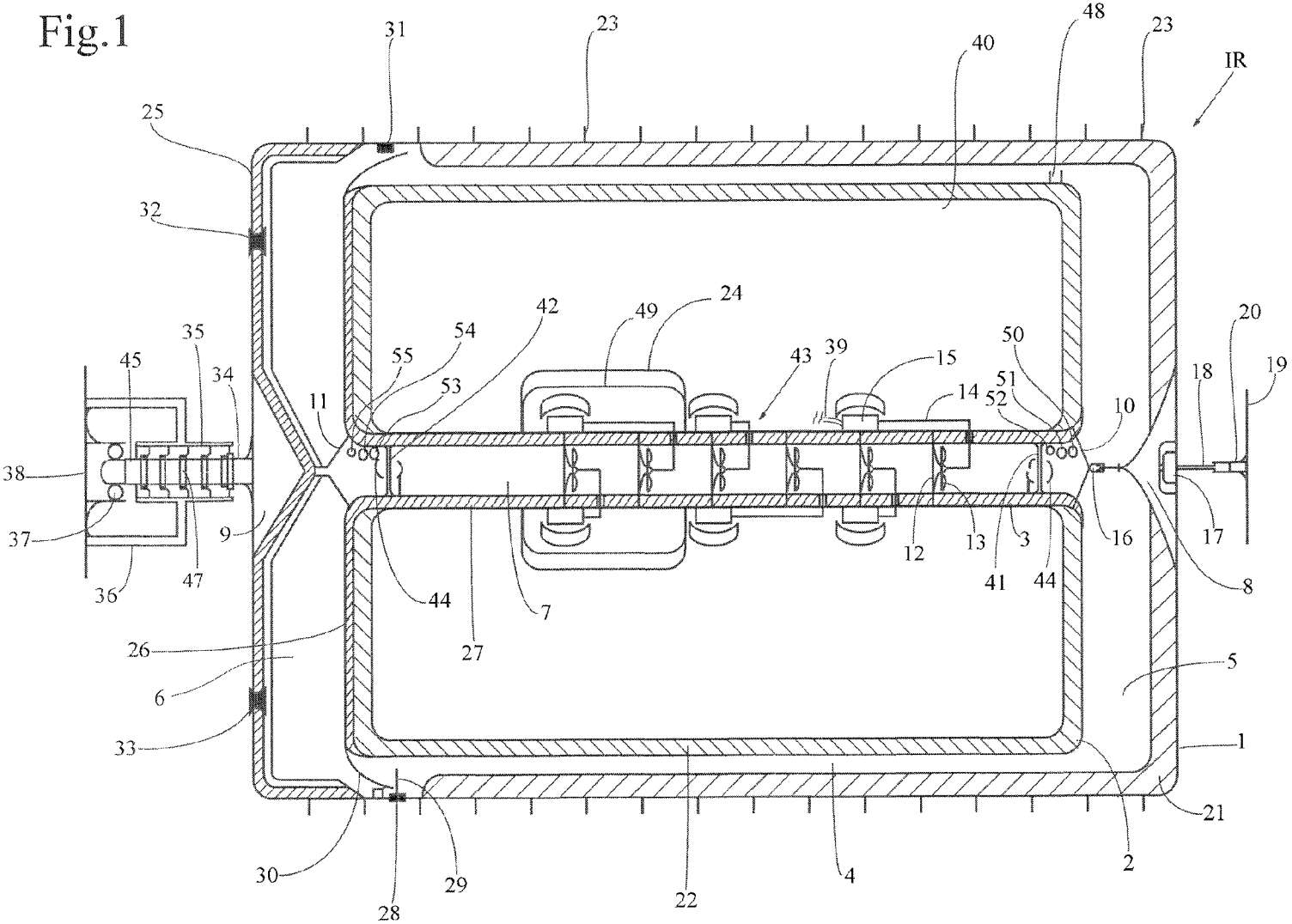

External unit representing the various external units, part of a larger assembly in which the installation and process, object of this application is a component. The external unit/s includes electric loads, monitoring, and control components, hereafter also referred to as EU. The inner rotor IR is a rotating structure inside the OS separated from it by vacuum and supported by the OS in two support surfaces 19, 38 (FIG. 1).

The main structure of the IR is made of three parts, one inside the other, fixed to each other around their common rotation axis. Outer cylinder, 1, constituting the outer skin of the IR is a hollow, closed cylinder. It is made of thermally conductive material typically metal such as aluminum or steel which is thick enough to sustain the pressure applied by the fluid inside it in its cavities 4, 5, 6, relative to the conditions of vacuum outside it between itself and the OS.

The electromagnetic absorption/interaction behavior (hereafter "color") of the outer cylinder, 1, is such that allows as much absorption of the widest spectrum of electromagnetic radiation possible so as to receive the heat radiation coming from OS through the vacuum and pass it on into the fluid situated in cavities 4,5, (cavity 6 being thermally insulated).

Around outer cylinder 1, on its outside are fixed circular heat exchange fins, 23, which are of the same material and color, and are fixed onto Outer cylinder, 1, in a thermally conductive manner. The role of these fins, which are perpendicular to the outer cylinder's 1 surface and to its axis is to increase the exchange area through which OS's radiated electromagnetic energy is passed—thus allowing the thermal energy from around the OS to be conveyed all the way into the fluid situated in the non-insulated cavities 4,5 as efficiently and least obstructed, least refracted manner possible—as its source of thermal energy.

Opposite these fins, 23, attached to the internal surface of the outer cylinder, 1, are heat exchange fins 21, which are perpendicular to its surface and parallel to its axis. These fins run along the outer cylinder's 1 length and converge toward the center on its basis in a manner by which they are immersed inside the fluid which would be flowing from base to base in cavities 4 and 5 during regular operation with the least resistance to flow possible. These fins, 21, which are parallel to the flow pattern of the fluid in cavities 4, 5 are made of the same material as the outer cylinder 1, are of the same color, and are attached to it in a thermally conductive manner. Their purpose is to increase the heat exchange area between outer cylinder, 1, and the fluid inside it.

Centered on the outer cylinder's 1 axis, on its non-insulated base is fitted an electric motor, 17, which has its rotor 18, fitted in a sleeve 20, fixed onto the outer shell's support surface 19.

This electric motor has the purpose of rotating the IR relative to the OS and in absolute terms acting as centrifuge. The motor 17, is fitted to outer cylinder 1, in a thermally conductive manner to allow the heat losses inside it (due to friction and electric resistance losses) to be returned as efficiently as possible into the fluid inside cavity 5.

The sleeve, 20, allows for movement along the axis, to permit for temperature related expansion/contraction, but does not allow rotation of the rotor 18, inside it. This is to allow the rotor the required counter force to enable it to generate rotation.

On outer cylinder's 1 other base, on and parallel to, its axis is fixed the support rod 34. The support rod 34, is held inside a bearing 37, which is fixed to the support surface 38, of the OS in a manner which allows for free minimal friction rotation movement, but no movement along it. Around support rod 34, which is hollow, is fixed an electrically insulated cylinder 45, support rod 34 passes through it. This cylinder 45, has several circular, electrically conductive tracks, 47, placed on its surface. Each of these tracks is electrically connected to an otherwise insulated conductor, passing through support rod 34, into outer cylinder 1, in a manner which is hermetically sealed for any flow between the inside and outside of outer cylinder 1.

A second cylinder 35, also hollow, and made of electrically insulated material is placed around cylinder 45, and is fixed onto OS by support/conductor passage hermetic channels 36. Inside this cylinder 35, are fixed electrically conductive brushes 46 which are each pressed against a corresponding conductive ring. This is done in a manner that as IR rotates inside OS, electric conductivity is continuously maintained between the conducting cable connected to the ring from IR and the electric conductor connected to the brush. For improved conductivity, several electrically connected brushes may be assigned to be pressed against each ring.

Each brush (or group of brushes assigned the same ring) are electrically connected to one electric conductor (which is otherwise insulated) which runs through the channels 36, toward the outside of OS. This allows for a continuous electric conduction to be made for each cable between the outside of OS and the inside of IR even in rotating conditions (comparable to typical electric motors/alternators power feed) while maintaining hermetic conditions for fluid flow.

This sliding connection allows for the passage of three types of electric current: power, monitoring signals, and control signals, as will be explained later on. Depending on considerations related to cost, dimensions, complexity, etc. of the installation other forms of power and/or signal transmission may be used such as electromagnetic coupling or transmission.

On one of the two bases of outer cylinder 1, near cavity 6, two valves are fitted 32, and 33. Valve 32 is a one-way no-return valve which allows fluid to flow into cavity 6 of the IR but does not allow fluid to flow outwards. It is normally closed since the IR's cavities in normal operation are designated to be filled with fluid under pressure and the gap outside IR, between IR and OS is practically vacuum. Valve 33 is a manual two-way valve which is normally closed. Valve 32 can be used to pressurize the cavities of IR with fluid by pressurizing the gap between OS and IR and thereafter evacuating fluid from the gap without losing pressure inside IR. Valve 33 allows the manual pressurization/release of pressure inside IR, if so required. To avoid/reduce over time pressure loss and vacuum degradation in practical installations, these valves may be replaced/covered by welded cover patches.

On each of the bases of outer cylinder, 1, on the axis points, is fixed a cone-like structure, cones 8, 9. Each of the cones is fixed at its base to Outer cylinder's 1 base in a thermally conductive manner and with common axis with outer cylinder 1. The main function of these cones is to facilitate the flow of the fluid between the cavity 4 (running along the perimeter) through cavities 5,6 and the central cavity 7, with minimal turbulences, promoting as much as possible smooth Laminar flow. These flow cones are not perfect cones—their walls connecting the base to the tip are of parabolic profile, rather than straight, when observed from the side, for a smooth flow direction change. These flow cones are made from the same material as outer cylinder 1. To flow cone 8, is fixed a sleeve 16, which is also on its axis and which firmly holds inside it support structure 11. Flow cone 9 is fixed to support 10. Support structures 10 and 11 are rod structures, each made of six equal-length rods which are attached to each other at 60 degree angles, and which are attached at their opposite ends around the perimeter of the inner cylinder 3. In each of the support structures 10, 11, an additional rod is connected at the center and which is positioned to be on the axis of outer cylinder 1. This rod fixes the respective support structure to the flow cone 9, and, in cavity 5, inside the sleeve 16, attached to flow cone 8.

These two rod-based support structures have the function of connecting the three main parts of the IR: outer cylinder 1, middle cylinder 2, and inner cylinder 3. This is done while allowing them to have a common axis and allowing fluid present in cavities 4,5,6,7, to flow with minimal flow resistance from supports 10 and 11. A middle cylinder 2, is a cylindrical closed structure of same material and color as outer cylinder 1, which is forming a closed, hollow cylinder structure with two parallel bases. The middle cylinder 2, has the same axis as the outer cylinder 1 and is suspended inside outer cylinder 1 by its two bases around the axis points by support structures 10 and 11 attached firmly to the tip of flow cone 9 and fixed inside sleeve 16, respectively.

Inside the middle cylinder 2 is fixed an open-ended cylinder 3 which is a cylinder of same material and color as middle cylinder 2. The inner cylinder 3 has the same axis as the middle cylinder 2 and outer cylinder 1, and is connected around its perimeter to the bases of the middle cylinder 2, with the part of the bases of middle cylinder 2 which overlap the bases of inner cylinder 3, removed.

The combination of these two cylinders 2, 3 makes for a closed cylinder with a hollow tube passing through its bases. The middle cylinder 2 and the inner cylinder 3 are connected at the perimeter of inner cylinder 3 in a hermetic manner which does not allow fluid to flow between the cavities 4,5,6,7 (which are freely connected between each other) and cavity 40 inside the middle cylinder 2. On middle cylinder 2, there is a small hole 48, to allow for the pressure equalization between cavity 4 and cavity 40. On the surface of the middle cylinder 2, on the inside walls and perimeter, there are additional heat exchange fins 22, which are thermally attached to it. These fins are of same material and color and are each perpendicular to the surface to which it is attached. The configuration of these fins may vary and their purpose is to increase the heat exchange area, allowing the collection of heat produced by losses due to electric current and friction by the generators 15 which are inside cavity 40.

The heat exchange fins 24, placed on the generators' covers 49 are made of same material, color, and are designated to increase the heat exchange surface for maximal evacuation and recuperation of heat from the generators. This system of fins (emitting fins 24, coupled with receiving fins 22) contributes, together with the main, original ("original"—because it is the source replenishing the system of all its energy output) thermal energy from outside the OS to reheat the fluid flowing through cavities 4,5.

Inside the inner cylinder 3 is fixed an array of propellers 13, by support rods 12. The support rods 12 are of profile that minimizes their resistance to flow of the fluid in cavity 7. Each of the propellers is of wing (blade) angles which are adapted to the fluid flow circumstances around them so as to optimize their efficiency in converting fluid flow over them to output work (parameters such as velocities, densities, etc.). The propellers 13 are typically made of thermally insulated stiff material. The minimal number of propellers in the array is one and maximal number may vary and be up to n. The rotation screw direction of each propeller is opposite to the one before it so as to recuperate the angular flow kinetic energy component of the fluid around it which is generated by the resistance to flow of the preceding propellers. The wingspan of each propeller is of almost the diameter of the free cavity 7 around it. Each propeller is connected at its center by a rod—shaft connection, 14 to the rotor of its respective electric generator 15 (electric generator such as alternator or dynamo) in a manner that allows the rotation of each propeller 13 by the fluid flow through it, to actuate the rotor of the generator connected to it. The rod 14 passes through inner cylinder's 3 skin through a hole 43. Since in normal operation, the pressure of the fluid drops as the fluid flows in cavity 7 over the propeller array (coming from cavity 5 toward cavity 6), unless blocked, fluid would flow between the holes 43, cavity 7 and cavity 40. To avoid this, several solution configurations may be used: The rendering of the holes practically airtight or passing all the shafts, one through the other in one hole, etc.

The solution applied in the installation is that of covering the whole area of each hole-shaft-generator assembly by a hermetically sealing individual box 49, made of thermally conductive material and color, which is thermally connected to the body of the generator and fitted with radiation fins 24, as mentioned. This allows for the hermetic separation of cavity 7 from cavity 40, having the only fluid passage point between cavity 40 and the other cavities being hole 48 for pressure equalization. The output of each generator is separately lead outside the IR, outside the OS through insulated conductors, passing, fixed along the walls of inner cylinder 3, support rods 10, support rod 34, rings 47, brushes 46, channels 36. All passages through walls of these conductors are fitted to be hermetic to fluid flow.

A possible optional useful alternative to this generator-propeller array—shaft-cover box arrangement may be that of fixing the rotor of each generator onto the respective propeller to allow it to be an integral part moving with (and even shaped as) the propeller, and the stator around it, fixed on the outside of inner cylinder 3. The material from which inner cylinder 3 is made is adjusted for this alternative accordingly so as not to disrupt the electromagnetic interaction between the rotor and stator. This alternative has several advantages: no direct fluid passage between cavity 7 and cavity 40, no moving parts inside cavity 40 etc.

An additional optional alternative to independent propeller-generator-load array may be to attach in groups or, all, the propellers to the same generator-load assembly and adjusting each propeller's profile and rotation rate ratio (by connecting each propeller to the generator's rotor through cogwheels of given radius ratios) adjusting the fluid's interaction with it to contribute to maximal additional power output on the load. Such adjustments may be carried by manual testing. This solution has several advantages such as reduced cost, weight, space requirements etc. it may be, however, less flexible in adapting to a wide range of working conditions.

The generators may be distributed around cavity 7 in a manner that would ensure symmetric weight distribution around the rotation axis to avoid vibrations, added friction and material stress related to the rotation. The same principle is applied to all the components of the installation, adding where necessary counter weights to position the whole installation's center of mass, as much as possible, on the rotation axis. In each of the two extremities of inner cylinder 3, three gauges are fixed: pressure gauge 52, 55; temperature gauge 50,53; and fluid velocity gauge 51, 54. The pressure and fluid velocity gauges may be combined by using instruments such as Pitot tubes measuring static, dynamic and stagnation (overall) pressure.

These gauges all provide data about their measured parameter as electric signal (voltage, electric resistance variations, or any other method commercially readily available). The signal passes through the same channels as the power output conductors, through dedicated ring 47, brush 46 couplings in the sliding connection all the way to outside the OS to be read on counterpart reading equipment in the EU, converting this electrical data to readable (or other useable output form). The passage of the signal to outside the IR and OS is done by insulated conductors contained in channels which are hermetic to fluid flow.

In the IR, inside and in between the cylinders, there are cavities which in normal operation would be pressurized with fluid (typically in gas state). Cavity 40 is the free space which is outside of inner cylinder 3, and inside middle cylinder 2, and is essentially separated from the other cavities with the exception of pressure equalization through breather hole 48. Inside this cavity are the cover boxes 49, of the generator assembly which prevent fluid passage between inside inner cylinder 3 (through holes 43) and cavity 40. This cavity may be sectioned by hermetic or tightly fitted plates made of thermally conducted materials to improve the transfer of thermal energy from the generators and fluid inside it to the fluid inside cavity 4 and cavity 5. In addition, these separators, which, viewed from one of the bases-section the circular base, prevent fluid from moving in angular motion around the axis. A cavity 7 inside inner cylinder 3 is connected through its two extremities to cavity 5 and 6 for free flow of fluid. The fluid in this cavity is designated to flow freely in normal operation from cavity 5, over the propeller array to cavity 6. Inside the perimeter walls of inner cylinder 3, around this cavity, a thermally insulated layer 27, made typically of rubber, rock, or glass wool is fitted to reduce to a minimum any heating of the fluid inside cavity 7 by the heat of the generators or any other source passing through cavity 40. Cavity 6 is the free space between the base of middle cylinder 2 and the base of outer cylinder 1 (and cone 9). This cylindrical cavity connects between cavity 7 and cavity 4, allowing for free flow of fluid. Around this cavity a thermally insulating layer 25, 26 is fitted, covering the inside of outer cylinder's 1 base and the cone 9, and covering the outside of middle cylinder's 2 base. This insulation is made of same material as insulation 27 and has the role of preventing thermal conduction through the walls. The fluid passing through cavity 6 is designated to be of substantially lower temperature than the environmental temperature and is required to remain so until it exits toward cavity 4. This cavity, 4, is the space between the outside perimeter of middle cylinder 2 and the inside of the perimeter of outer cylinder 1. In this cavity, the fluid flowing from cavity 6 to cavity 5 is exposed to heat from the outside of IR and to heat coming from the inside from cavity 40. The fluid in this cavity enters at cooled temperature from cavity 6 and exits at higher temperature toward cavity 5. The cavity 5 is the free space between the base of middle cylinder 2, and the base of outer cylinder 1 (and its cone 8). This cylindrical cavity connects between cavity 4 and cavity 7, allowing for free flow of fluid (in normal working conditions from cavity 4 to cavity 5 to cavity 7). The three cavities 6,4,5 which are interconnected for fluid flow and which are connected to the central cavity 7, are sectioned by at least one theoretical plane (passing through the axis line). On this theoretical plane are positioned real plates in the cavities which prevent fluid from moving freely in angular motion around the rotation axis relative to the cavities. These plates limit the motion of the fluids within the cavities to flow as follows: in cavities 5 and 6—along the radius line- and in cavity 4, parallel to the rotation axis. These plates are (almost or fully) hermetic to passage of fluid and are not present (are cut off so as not to disrupt) in spaces designated to having other components such as skirt seal 30 (or an array of valves) and motor 28, support rods 10, 11, and cones 9,8. The cavities may be sectioned also by plates situated on two or more equally angled planes (appearing like "slices of a pie" when viewed from one of the bases).

Figure 6:
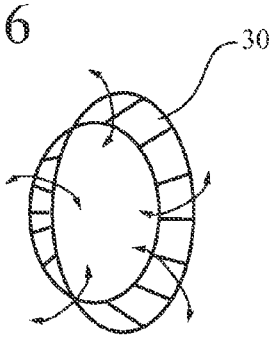
FIG. 6 is a perspective view of the seal skirt.
Figure 7:
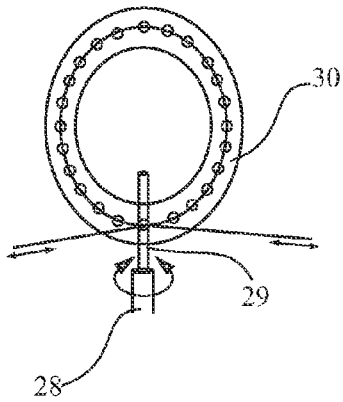
FIG. 7 is a front view of the seal skirt with its control motor.
Figure 8:
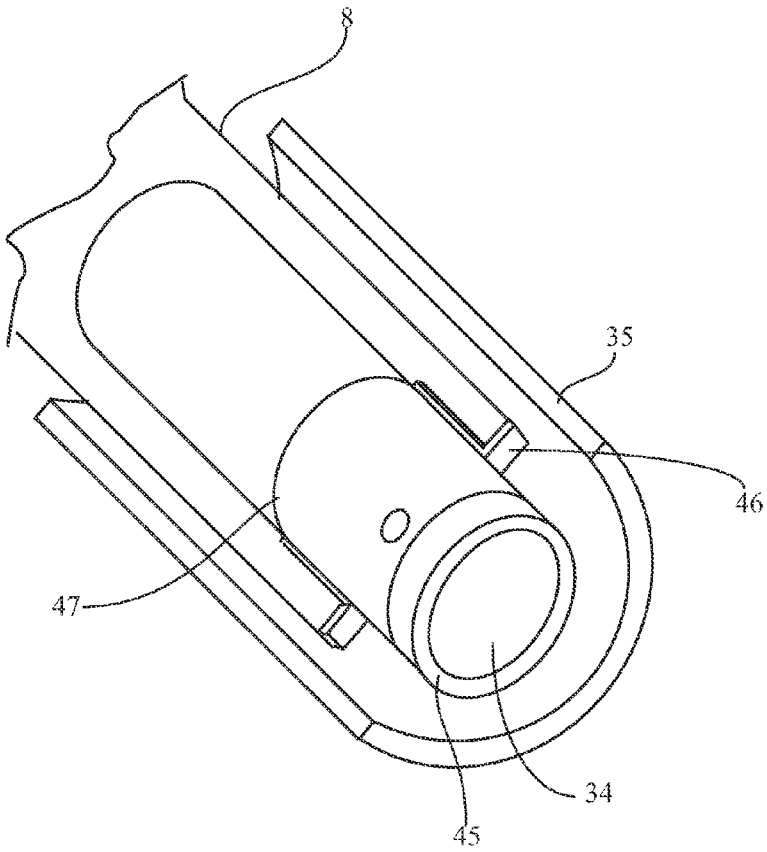
FIG. 8 is a partial perspective view of a sliding electric connector
Figure 9:
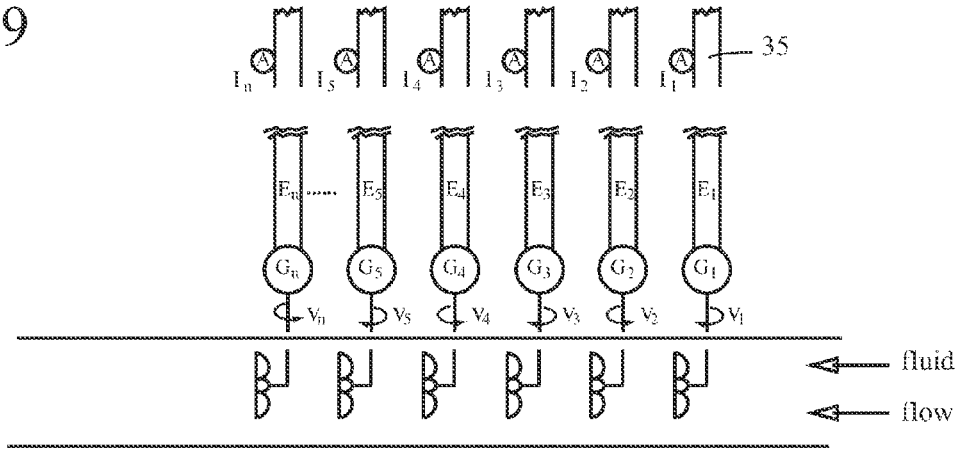
FIG. 9 is a schematic description of the propellers-generators-loads connections.

In the IR there are three adjustable valves or seals, two of which 41 and 42, equipped with control motor 44, are situated in cavity 7. These two seals are circular and may vary between two extreme positions, open and closed. In open position, the seals have minimal resistance profile to flow of the fluid through them, and in closed position hermetically seal off any passage of flow through them. These two seals are controlled independently from each other by the EU situated outside the OS. The seals' motors 44 are powered and activated through insulated conductors connected through the sliding connectors by individual ring 47, brush 46 couplings. Their insulated conductors pass through the walls of the cylinders on their path to the rings 47, in a hermetically sealed manner through the passage points. For these seals 41, 42, any appropriate commercially available seal with similar functionality parameters may be used. The third seal, 30, is made of a rubber skirt-like elastic band (hereafter "rubber skirt" or "skirt") which is fixed hermetically around the outside of middle cylinder's 2 base, against the insulating layer 26. Inside the rubber skirt at regular intervals, are placed flat stiff strips which are strong elastic and normally straight (FIG. 6). These strips impose on the rubber skirt to hermetically press against the inner surface of the outer cylinder 1 all around its perimeter, pressing hermetically against the circular gasket 31. Around the rubber skirt a belt is fixed which is fitted with a repeated pattern of extensions (or "teeth") connected to the rotor 29 of the skirt diameter controlling motor 28. The rotor 29 is also equipped with counterpart teeth and controlled from the outside in the same manner as the other seals. The motor 28, by rotating and fixing its rotor at a given position closes or opens the belt by pushing against its teeth thus establishing the skirt's outer diameter, allowing it to vary its function to being a complete seal, a fluid backflow limitator, or non-interfering with the flow by closing the belt to be completely pressed against the middle cylinder's 2 outer perimeter surface. Any other available valve solution may be used instead of the skirt valve.

Figure 2:
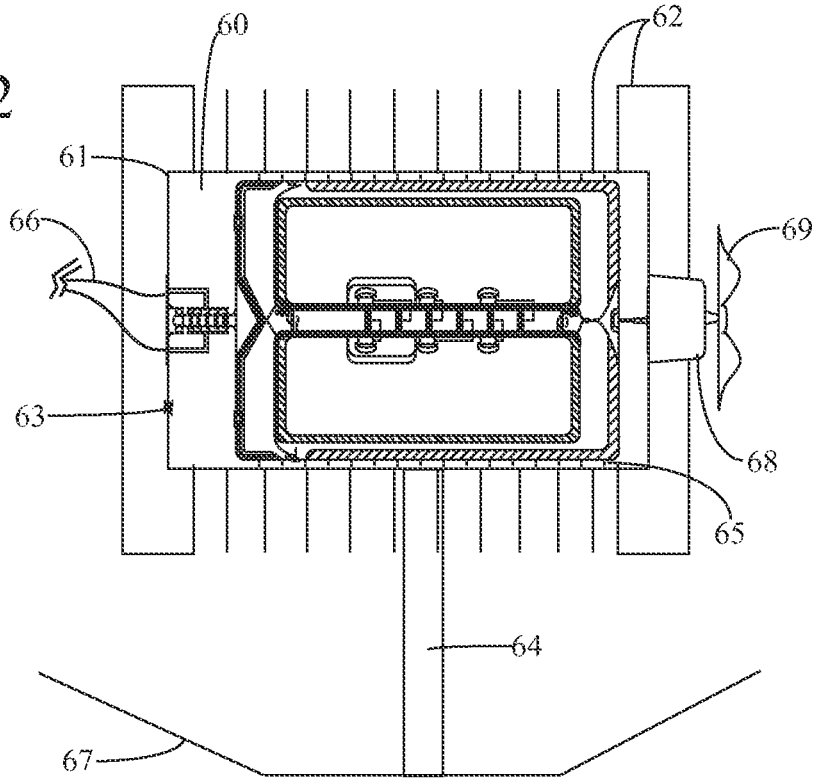
FIG. 2 is a schematic cross axial section view of an overall installation.

The outer shell 61, is a hermetic closed box within which the IR is fitted. This box is made of thermally conductive color and material such as aluminum or steel and is of sufficient strength to withstand the environmental pressure outside it relative to the vacuum conditions existing between itself and the IR in cavity 60 in normal working conditions (FIG. 2), On the OS is fixed a manual valve 63, through which fluid can be pushed in or out, allowing for the pressurization of the cavities inside IR (through no-return valve 32) and, afterward, the evacuation of as much fluid as possible from cavity 60. This valve in normal working conditions is closed.

The fins 62 are of thermally conductive material such as aluminum or steel and of absorbing color, same as that of the body 61 and the IR. These fins are connected to the body 61 in a thermally conductive manner and have the purpose of increasing to a maximum the heat exchange surface through which the OS receives energy from the environment and passes it on through cavity 60, by electromagnetic radiation, into the pressurized fluid situated in the cavities inside IR. The number of fins, their form, and pattern may vary greatly and depends on the circumstance of use. An example of such pattern may be "cage"-like structure of several layers allowing fluid from around the OS to pass maximal heat and flow freely. In this context, the form of the body of the OS, 61, may also vary greatly from cylinder, box, ball or any other shape depending on the circumstances of use.

The fins 65 inside OS are made of same material and color as IR's fins 23, and serve as their counterparts in order to increase the emitting/receiving surface of radiation between OS and IR. The cables 66 are insulated conductors which carry between the EU and the IR power monitoring and control electric currents. These cables are fixed in a manner which is hermetic to any fluid flow between the outside and the inside of the body 61 of OS.

The support 64 is made of stiff material to hold the OS suspended/attached to the supporting platform. The basin 67 is a collector which is optional and serves to collect condensate liquids such as water for beneficial use. Since under working conditions, the temperature inside OS drops, the fins 65 and the fins on IR are distanced so as not to touch under any design working temperature gradients (since the IR rotates inside OS). On the body of OS 61 an optional electrical motor 68 may be fixed in a thermally conductive manner and fitted with a propeller 69 to increase the exposure of OS to continuously newly arriving environmental fluid's molecules thus increasing the net heat received by the system over a given period of time.

The motor actuates the propeller which creates flow. The power for the motor arrives through the insulated conductors 66 and is limited to be a portion of the produced effective overall output power of the system which is clarified in the description of the process. This motor 68 may be used to generate propulsion, motion, or beneficial fluid circulation. For example, such a system when immersed in water may propel its platform (vessel), provide cool air circulation, etc. in configurations by which the requirement is that the power output of the process is maximized, the portion of the available output power which is directed towards this motor is adjusted so as to receive maximal net output remaining.

The EU may be materialized in numerous forms and configurations and will therefore be described here only in its functionality. The EU is the unit which interacts with the installation's components: receiving power, controlling motors and valves (also seals) and monitoring pressures, temperatures, fluid velocities as well as feedback from controlled components such as motors and valves (also seals) speeds and positions respectively.

The power received from the IR's generators is channeled through the insulated conductors to the EU. Through the EU, each generator output is distributed to fall on an adjustable electric load as per the requirements detailed on the propeller array section. In addition to the loads which are the outside users, the EU redirects a portion of the power through adjustable electrical loads, circuit protections, switches and/or controls as per the specifications of each commercially readily available component, to the installation's motors and valves (or seals). The controls establishing rotation speeds and valve positions whether analog or digital may be incorporated or separate from the power supply.

The output signals which are emitted by the various components provide their reading about parameters external to themselves (such as temperature, pressure, fluid velocity) or feedback about their own functionality (such as motor speed, valve position). This data whether analog or digital, whether carried through by the insulated conductors or in any other way (such as radio transmission) needs to be output and converted to readable form (readable by man or machine), and this function is carried through the EU component. The simplest useable form is, for example, an analog meter which is readable by an operator but the variations are many and will often depend on the overall configuration of the installation and of the larger assembly, within which the installation is only a component.

Figure 4:
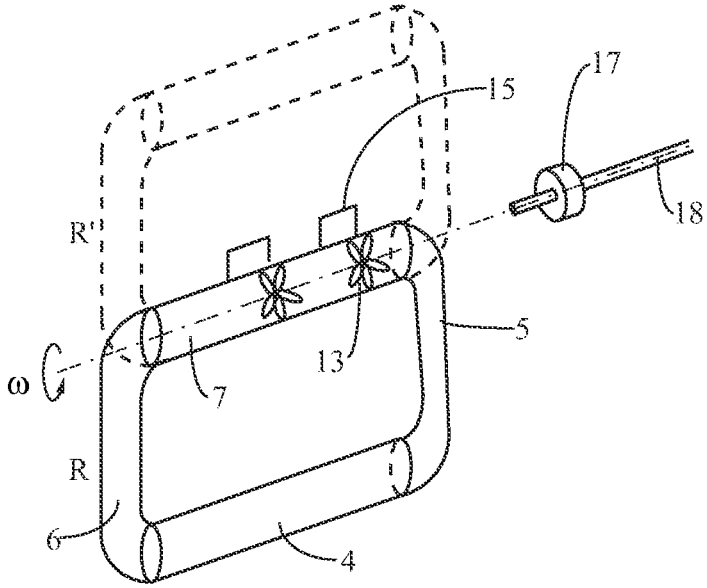
FIGS. 4 and 5 are partial schematic views in perspective and cross section of the installation.
Figure 3:
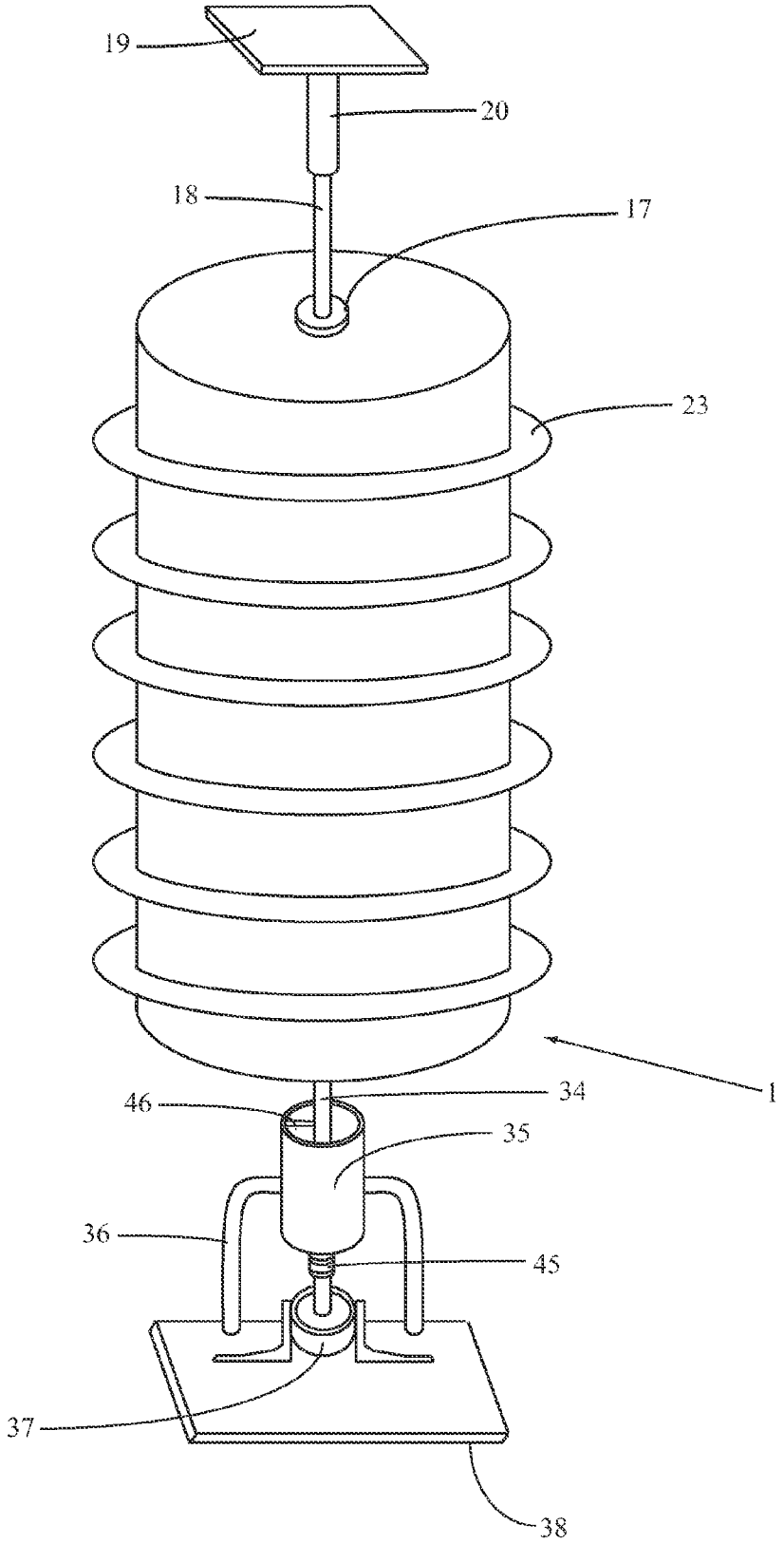
FIG. 3 is a perspective view of the inner rotor.
Figure 5:
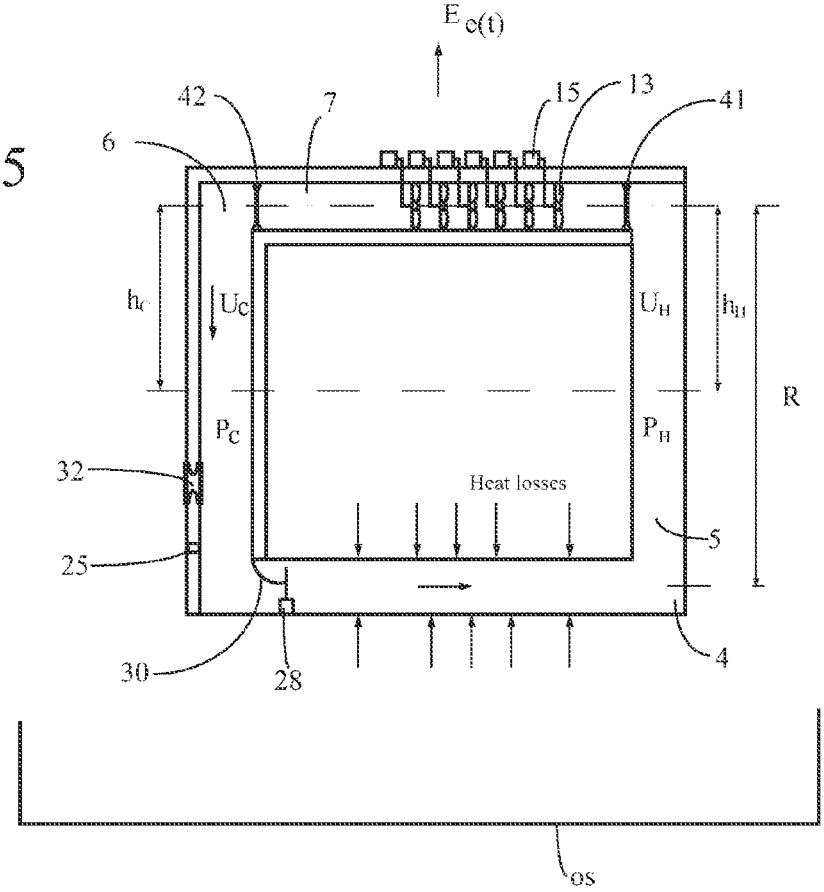

Since the process, object of this patent application may be embodied as installations of vast variations of dimensions, parameters, forms, and configurations; it shall hereafter be described within a standardized, simplified forms and arrangements. This is done to allow the applicable principal physical principles to be expressed in their most straightforward form. To do so, the IR is described in schematic standardized form as per FIGS. 4, 5. As the fluid flows, in two symmetric opposing paths with practically the same behavior, one of the paths was blocked off and ignored as shown in FIG. 5 of the same drawing (the central cavity 7 is used exclusively for the analyzed remaining flow path). The number references to various components in the schematic form were kept as identical as possible to those of the other drawings to allow for a comparison and mutual reference. The section area of the cavities is the same all over and dimensions symmetric.

Fluid is pressurized into the cavity 60 between the OS and IR. The fluid passes through the directional no-return valve 32, into the cavities of the IR. This fills with a homogenously pressurized fluid all the cavities of IR including cavities 4,5, 6,7 and, through the small breather hole 48 also cavity 40. Once the desired pressure is reached, the fluid pressure around the IR is dropped, thus causing no-return valve 32 to lock closed, maintaining the cavities inside the IR pressurized at levels around the peak pressure. The fluid is evacuated from the cavity 60 between the OS and the IR by pumping it out, to reach almost absolute vacuum conditions. Once this stage is completed, the OS is placed in an environment which is very significantly cooled (by external means) relative to the normal working environment temperature (note: in practical conditions, target temperature is such that would make the fluid reach temperature which is just above phase change). Sufficient time is passed, so as to cool homogenously all the parts and fluid inside the IR, including the insulated parts. Once the desired cold temperature is reached throughout the IR, the seal 42 is closed and seals 41 and 30 are almost completely closed, allowing only small passage of flow of fluid to equalize pressures. While still cold, the motor 17 is activated, rotating the IR to the desired rotation angular frequency (ω) acting as centrifuge. The OS is kept within the same cold environment until the temperature stabilizes also under rotation conditions.

At this point in time, the OS is placed in a normal typical work environment (which is of significantly higher temperature than after the cooling). The temperatures inside the IR's cavities start to rise due to the radiation emitted by consequence of the environmental thermal energy, received from the OS through the vacuum cavity 60 between the OS and IR. The temperature of the insulated areas rise much less than the temperatures of the non-insulated areas, since their slope of temperature increase over time is much more flat, requiring a longer time to reach the same temperature as the non-insulated parts. The temperatures of the insulated and non insulated sections are monitored, adjusting the exposure time to reach maximal differential.

These variations of temperatures of the fluid inside the IR's various cavities, causing corresponding density differences between the fluid in the colder areas and the fluid situated in the warmer areas, coupled with the centrifuge conditions to which the fluid is subjected by cause of the rotation, generate pressure differentials between the warmer and colder fluid. These pressure differentials cause the flow of the fluid from high to low pressure areas seeking pressure equilibrium (Note: the angular frequency is adjusted so as to observe peak pressure differential between both ends of cavity 7). Once this flow stops and the fluid in the cavities is at practical rest conditions of no or insignificant flow, the cavities have fluid inside them which can be expressed as follows:

Cavity 6 containing the colder fluid shall be referred to also as the "cold column." The fluid in the cold column at this point in time has relevant energy.

Cold column fluid energy=enthalpy+potential(due to centrifuge)energy

Working assumption for the standardized process is that the gravitational force is inexistent or insignificant relative to the process working parameters.

It is to be noted that for rotating axis parallel to Earth's horizon, the gravitational force on the fluid in the hot/cold columns constantly rotates. Since the centrifugal potential energy is relative to a chosen surface of reference, the overall energy, at zero fluid flow velocity can be presented as follows:

Relative to the rotation axis:

$$E_c=(\gamma/(\gamma-1))p_c v_c-(1/2)m_c\omega^2 h_c^2 \quad 1)$$

Relative to the center of mass of fluid inside Cavity 4:

$$E_c=(\gamma/(\gamma-1))p_c v_c+(1/2)m_c\omega^2(r^2-h^2) \quad 2)$$

Note:

$$\gamma=c_p/c_v \quad 3)$$

$$\gamma=H/U \quad 4)$$

$$H=U+PV \quad 5)$$

$$R=c_p-c_v \quad 6)$$

Where $E_c$: Relevant energy of the fluid in the cold column
γ: Ratio of Specific heats
$c_p$: Specific heat of the gas under constant pressure
$c_v$: Specific heat of the gas under constant volume
H: Enthalpy
U: System's fluid's Internal Energy
P: Pressure
V: Volume
R: Universal gas constant
$p_c$: Pressure of the fluid in the cold column (at fluid's center of mass)
$v_c$: Volume of the cold column
$m_c$: Mass of the fluid in the cold column
ω: Angular frequency
r: The radius or distance between the rotation axis and the center of mass of the fluid which is inside Cavity 4
$h_c$: The radius or distance between the rotation axis and the center of mass ($m_c$) of the fluid inside the cold column Cavity 5 containing the warmer fluid would be referred to also as the "hot column." The fluid in the hot column has relevant energy of:

Hot column fluid energy=Enthalpy+potential(due to centrifuge)energy

The overall relevant energy for the fluid in the hot column, at zero fluid flow velocity can be presented as follows:

Relative to the rotation axis:

$$E_H=(\gamma/(\gamma-1))p_H v_H-(1/2)m_H\omega^2 h_H^2 \quad 7)$$

Relative to the center of mass of fluid inside Cavity 4:

$$E_H=(\gamma/(\gamma-1))p_H v_H+(1/2)m_H\omega^2(r^2-h_H^2) \quad 8)$$

Where $E_H$: Relevant energy of the fluid in the hot column
γ: Ratio of Specific heats
$p_H$: Pressure of the fluid in the hot column (at fluid's center of mass)
$v_H$: Volume of the hot column $m_H$: Mass of the fluid in the hot column ω: Angular frequency r: The radius or distance between the rotation axis and the center of mass of the fluid which is inside Cavity 4

$h_H$: The radius or distance between the rotation axis and the center of mass ($m_H$) of the fluid inside the hot column Since at the preparation phase seal 42 is closed and seal 30 is slightly open the fluid in the cold column and in the hot column, once rest (or insignificant flow) conditions are reached, are of practically equal pressure at their "bottom" (cavity 4).

In the standardized installation conditions assume equal volumes for both columns and similar mass distribution with insignificant difference of the center of mass of the fluids relative to the overall radius (r). and therefore, in good approximation:

$$v_c=v_H=v \quad 9)$$

$$h_H=h_c=h \quad 10)$$

The fluid behaves as ideal gas, for example—monatomic, remaining in gas state throughout the process (with no phase change and at temperature significantly higher than that of phase change, ignoring therefore, latent heat related energy variations).

Therefore:

Since there is no flow:

$$p_{H\,b}=p_{c\,b} \quad 11)$$

and so, $$[(\gamma/(\gamma-1))p_H v+(½)m_H\omega^2(r^2-h^2)]/v=[(\gamma/(\gamma-1))p_c v+(½)m_c\omega^2(r^2-h^2)]/v \quad 12)$$

Note:

$$m_H=\rho_H V \quad 13)$$

$$m_c=\rho_c V \quad 14)$$

Where, $p_{H\,b}$: Static pressure at the bottom of the hot column (at end of Cavity 4).

$p_{c\,b}$: Static pressure at the bottom of the cold column (at other end of Cavity 4).

$\rho_H$: Hot column fluid average density $\rho_c$: Cold column fluid average density Therefore, $$(\gamma/(\gamma-1))p_c=(\gamma/(\gamma-1))p_H-(½)\omega^2(r^2-h^2)(\rho_c-\rho_H) \quad 15)$$

Note: Since $\rho_c$, being the density of colder gas than $\rho_H$, $\rho_H<\rho_c$. This implies, based on equation 15 that: $p_c<p_H$. (note: this is true provided ω is within earlier established working range).

At the top of the hot column, (on the rotation axis), the static pressure is:

$$p_{Ht}=(\gamma/(\gamma-1))p_H-(½)\rho_H\omega^2h^2 \quad 16)$$

At the top of the cold column, the static pressure is:

$$p_{ct}=(\gamma/(\gamma-1))p_c(½)\rho_c\omega^2h^2=(\gamma/(\gamma-1))p_H-(½)\omega^2(r^2-h^2)(\rho_c-\rho_H)-(½)\rho_c\omega^2h^2 \quad 17)$$

The initial static pressure differential at the top is therefore:

$$\Delta p_t=p_{Ht}-p_{ct}=(½)\omega^2(r^2-h^2)+(\rho_c-\rho_H)+(½)\omega^2h^2(\rho_c-\rho_H) \quad 18)$$

Where, $p_{H\,t}$: Static pressure at the top of the hot column (at end of cavity 7).

$p_{c\,t}$: Static pressure at the top of the cold column (at other end of cavity 7).

$\Delta p_t$: Static pressure differential between both ends of cavity 7.

The consequence of this is that initially, after the preparation phase is completed, at the top of the hot and cold columns on both ends of cavity 7 there is pressure differential. This pressure differential, upon opening of the seals, would generate fluid flow through cavity 7 from the hot column toward the cold column.

Upon the opening of the seals, so that the flow can occur within the cavities, the pressure at the top of the hot column is of higher pressure than the pressure at the top of the cold column. It therefore forces the fluid to flow through cavity 7 to the cold column.

The propeller array (which is of minimum one propeller) is therefore actuated by the fluid flow, doing work outside the cavity (thus outside of the fluid's closed system (hereafter "the system")), through the shafts to the electric generator/s (turning their rotors).

Each of these generators (such as alternator or dynamo) develops electric voltage as electric output in consequence of the rotor actuation.

In simplified terms, this voltage, by Lenz's Law, can be represented as $$E=NBul \quad 19)$$

Where,

E: electromotive force

B: density of the magnetic field u: velocity of the conductor in the magnetic field l: length of the conductor in the magnetic field N: number of conductor turns This electromotive force, once applied to an electric load (which is outside the installation's IR-connected through the sliding connector 35 (For simplicity assume load to be of only real resistance under direct current conditions) generates electric current.

This electric current can be represented as follows:

$$I=E/Z=NBul/Z \quad 20)$$

Where,

Z: electric resistance of the load

I: electric current passing through each generator's electric output circuit and through its corresponding external load (see schematic Electric Connections drawing).

This current, in turn, causes a counter force which resists the motion of the conductor (relative to the magnetic field) and therefore, the rotation of the rotor in the generator and by consequence applies through the shafts a force resisting the turning of the corresponding propeller. By consequence this force resists the fluid flow through the propeller array in Cavity 7.

The force on the conductor moving within the magnetic field in each generator can be represented, in simplified terms, as follows:

$$F=NBIl=N^2B^2l^2u/Z \quad 21)$$

Where,

F: counter force (between the conductor and the magnetic field in which it is) generated by the current through the conductor (and the corresponding adjustable load) and which is of direction opposite the force which originally caused the motion. The resistive force (which—through the shaft—resists the turning of the propellers and therefore the flow of the fluid), can be modulated by adjusting the electric resistance.

Through this interaction, the fluid flowing through the propeller array, outputs a portion of its energy, outside the system, through the generators to the loads (as well as to other losses in the generators and shaft friction outside the system). The fluid, being in gas form, transfers a portion of its molecules' kinetic energy outside the cavity (the system) by doing this work. Each of the molecules of the gas state fluid contributing to the rotation of each propeller, through its collision with one of its blades, bounces back from it at a slower velocity than the velocity in which it arrived at the blade. Each such molecule, bouncing back from the blade, collides thereafter with other molecules, propagating the lowering of the root-mean-square speed of the molecules of the fluid interacting with the propellers (or, in other words, cools the fluid).

This work, done by the system's fluid outside it (output to the generators' electric power and losses) causes the cooling of the gas-state fluid as it advances towards the exit of cavity 7, towards the cold column. The propellers are of profiles which, combined with their respective electric load, resistance value and fluid velocity around them are adjusted to optimize the energy absorption and transfer as electric current and losses outside the cavity. In practical cases, the electric resistances may be adjusted individually so as to witness the maximization of this energy extraction by the propeller array as a whole. The total energy which is output over a period of time, t, outside (including losses which are outside the system) shall hereafter be referred to as Ee(t) and/or "Electric Energy".

Note: In a propeller array of more than one propeller the rotation screw direction of each propeller shall be opposite to that of the propeller before it, to allow for the recuperation of the angular velocity of the fluid's molecules which are caused by the resisting force of the propellers before it. This is not to be confused with angular velocity which may be caused by Coriolis force within Cavity 7.

In consequence, of the output energy, the fluid exiting cavity 7 is colder than the fluid entering it. In stable steady conditions the temperature and mass of the fluid entering the top of the cold column from cavity 7 over each period of time t would be equal to the mass and temperature of the fluid which has been evacuated from the top of the cold column downward.

In such steady conditions the requirement is that the net thermal energy received from the environment (as well as from all other sources considered outside the system such as recuperated heat loss received from the generators in Cavity 40 and from the centrifuge motor's losses) be equal to the output electric energy over the same period of time.

In the standardized version consider that net heat transits through to the fluid in cavity 4 over a period of time, t, and shall be referred to as "heat" or $Q_{T(t)}$ this is due to the fact that its temperature is lower than the environment as will be shown. This heat is received from the outside environment by means of radiation (through the vacuum between OS and IR), by conduction through the walls of cavity 4 and convection of the fluid.

The fluid flowing from the bottom of the cold column into cavity 4 is significantly colder than the temperature of the environment. As it flows through cavity 4, towards the bottom of the hot column, it absorbs a portion of the net thermal energy received from the environment (environment being outside of OS as well as losses outside the system).

The thermal energy absorbed by the fluid is impacted by several factors such as the heat exchange surface with the fluid (hence fins 21,22,23), the conductivity of the cavity walls materials, the capacity of the cavity walls to efficiently absorb a maximal spectrum of electromagnetic waves, the velocity of the fluid in cavity 4 (which determines its exposure time note: flows relatively slowly in the standardized version. this allows also for flow to be as laminar as possible), its temperature differential relative to the environment, the length of cavity 4 and the turbulence level of the fluid inside Cavity 4 (more turbulent flow increases convection and therefore promotes more homogenous distribution of temperature inside the fluid).

Since the colder fluid is more dense, it would have a tendency to press against IR's, cavity's 4 outside walls (perimeter walls facing OS) thus contributing to receipt of energy from the environment.

The fluid at the exit of cavity 4 in steady work process is at temperature which is higher than its temperature at the moment of entry to cavity 4, but is still significantly lower than the temperature of the outside environment. It is of the same temperature and mass as the fluid which has been evacuated from the bottom of the hot column toward its top (the rotation axis) over the same period of time.

The immediate environment around the OS loses temperature in consequence of the heat which is transferred (by a combination of conduction, radiation, and convection) into the fluid. This received energy is at a level which will, thereafter, be output for various uses through the propellers, generators, and electric output circuits.

In intermediate summary, the steady, regular work process is as follows: the warmer fluid in the top of the hot column is of higher pressure than the colder fluid in the top of the cold column, causing fluid flow in Cavity 7, thus actuating the propellers, producing as output Electric Energy, $E_{e(t)}$ Having lost the equivalent of $E_{e(t)}$ energy, through the work which the fluid does generating electric power and losses, the fluid cools down and to the top of the cold column is added mass ($m_{(t)}$) of colder fluid. This added cooled fluid mass increases the cold column's density and therefore, the pressure in the cold column. This, by consequence, destabilizes the pressure equilibrium at the bottom and makes the same mass ($m_{(t)}$) flow from the bottom of the cold column towards cavity 4. In Cavity 4, the fluid gets gradually warmed by the environment around cavity 4, as it flows from the bottom of the cold column towards the bottom of the hot column, thus replenishing the hot column with fluid of temperature and mass ($m_{(t)}$), allowing its pressure, temperature and mass not to drop despite its loss of mass ($m_{(t)}$) from its top towards Cavity 7. This process is continuous as long as the required hereinafter established conditions, applicable to the various parameters are fulfilled.

Further considerations pertaining to the steady process in its standardized form:

In normal steady working conditions, the fluid inside the hot column may be represented as being of relevant energy, relative to the rotation axis as follows:

$$E_H=(\gamma/(\gamma-1))p_H v-(1/2)m_H\omega^2h^2+m_H u_H^2/2 \quad 22)$$

In the same steady working conditions, the fluid inside the cold column may be represented as being of relevant energy relative to the rotation axis, as follows:

$$E_C=(\gamma/(\gamma-1))p_C v-(1/2)m_C\omega^2h^2+m_C u_C^2/2 \quad 23)$$

Where, $E_H$: Relevant energy of fluid in the hot column relative to the axis consisting of Enthalpy, potential energy, and directional kinetic energy.

$E_C$: Relevant energy of fluid in the cold column relative to the axis consisting of Enthalpy, potential energy, and directional kinetic energy.

$\gamma$: Ratio of Specific heats $p_H$: Pressure of the fluid in the hot column (at fluid's center of mass)

$p_C$: Pressure of the fluid in the cold column (at fluid's center of mass)

v: Volume of the hot column and also of the cold column $m_H$: Mass of the fluid in the hot column $m_C$: Mass of the fluid in the cold column ω: Angular frequency r: The radius or distance between the rotation axis and the center of mass of the fluid which is inside Cavity 4 h: The radius or distance between the rotation axis and the center of mass ($m_H$) and ($m_C$) of the fluid inside the hot and cold columns, respectively $U_H$: The velocity of the fluid in the hot column $U_C$: The velocity of the fluid in the cold column Since in steady conditions the fluid in the hot column flows into Cavity 7, and the fluid in the cold column is received from Cavity 7, and, Since in steady conditions the mass $m_{(t)}$ received over a period of time (t), in Cavity 7 is the same as the mass passed forward into the cold column from Cavity 7 over the same period of time and, Since in steady conditions the system's overall energy levels, including those of $E_H$ and $E_C$ remain unchanged over time:

The following is in consequence:

The Electric Energy $E_{e(t)}$ which is work output over a period of time (t) is quantified as equal to the energy of the fluid received from the hot column over that time less the energy of the fluid of same mass, which exits to the cold column over the same time. (note: energy forms which are not influenced by the standardized process such as nuclear or chemical energy are ignored)

$$E_{e(t)}=E_{H(t)}-E_{C(t)} \quad 24.$$

Where, $E_{e(t)}$: the electric energy as well as all other lost energy (outside of the system—due to friction, etc.) received over a period of time (t) by consequence of the work done by the system.

$E_{H(t)}$: the energy relative to the rotation axis of the warmer fluid entering the propeller array over a period of time (t) from the hot column $E_{C(t)}$: the energy relative to the rotation axis of the colder fluid exiting the propeller array over the same period of time (t) towards the cold column Also in consequence, the ratio between the energy of the fluid entering the propeller array from the hot column over a period of time (t), $E_{H(t)}$ and the overall energy of the fluid in the hot column, $E_H$, is equal to the ratio between the mass $m_{(t)}$ passing through it over that time (t) and the overall mass ($m_H$) of the fluid in the hot column.

$$(E_{H(t)}/E_H)=(m_{(t)}/m_H) \quad 25.$$

And, in the same way: the ratio between the energy of the entering fluid, arriving from the propeller array into the cold column over a period of time (t) $E_{C(t)}$ and the overall energy of the fluid in the cold column $E_c$ is equal to the ratio between the mass $m_{(t)}$ entering the cold column over that time (t) and the overall mass of the fluid in the cold column $m_c$.

Therefore, $$(E_{C(t)}/E_C)=(m_{(t)}/m_C) \quad 26.$$

Combining the above equations:

$$E_{e(t)}=(m_{(t)}/m_H)[(\gamma/(\gamma-1))p_H v-(\tfrac{1}{2})m_H\omega^2h^2+m_H u_H^2/2]-(m_{(t)}/m_C)[((\gamma/\gamma-1))p_C v-(\tfrac{1}{2})m_C\omega_2h^2+m_C u_C^2/2] \quad 27.$$

Since the mass exiting the hot column and the mass entering the cold column over the same time, in steady work conditions are the same:

$$m_{(t)}(\text{in})=m_{(t)}(\text{out}) \quad 28.$$

Therefore:

$$\rho_H U_H tA=\rho_C U_C tA \quad 29.$$

Therefore:

$$U_C=(\rho_H/\rho_C)U_H \quad 30.$$

$$E_{e(t)}=U_H tA\{(\gamma/(\gamma-1))p_H+\rho_H U_H^2/2\}-U_H tA(\rho_H/\rho_C)\{(\gamma/(\gamma-1))p_C+(\rho_H/\rho_C)\rho_H U_H^2/2\} \quad 31.$$

$$E_{e(t)}=U_H tA\{(\gamma/(\gamma-1))p_H-(\rho_H/\rho_C)(\gamma/(\gamma-1))p_C+(\rho_H U_H^2/2)(1-\rho_H^2/\rho_C^2)\} \quad 32.$$

On the other side, analyzing the net thermal energy received over a period of time (t), $Q_{T(t)}$ in energetic equilibrium: the net heat received over a period of time $Q_{T(t)}$ which increases the system's overall enthalpy less the output work $E_{e(t)}$ leaves the system with unchanged energy levels:

$$E_4+E_7+E_c+E_H+Q_{T(t)}-E_{e(t)}=E_4+E_7+E_c+E_H \quad 33.$$

Where;

$E_4$: Relevant energy of fluid in cavity 4 relative to the axis consisting of enthalpy, potential energy, and directional kinetic energy.

$E_7$: Relevant energy of fluid in cavity 7 relative to the axis consisting of Enthalpy, potential energy, and directional kinetic energy.

And therefore:

$$Q_{T(t)}=E_{e(t)} \quad 34.$$

To express the relationship between $P_H$ and $P_C$ in steady working conditions, the following is considered: In steady working conditions, $E_H$ remains unchanged over time, and the same applies to $E_C$. This means that the fluid in the hot column and the fluid in the cold column are in equilibrium by which they flow through cavities 7 and 4, circulating through the columns, continuously receiving over every period of time (t), net thermal energy, $Q_{T(t)}$ and doing work, $E_{e(t)}$, which is equal to the thermal energy. The ratio between the energy values $E_H$ and $E_C$, remains unchanged. It is important to note, in addition, that $Q_{T(t)}$ being heat, increases the system's disordered molecular kinetic energy. $E_{e(t)}$, on the other hand is essentially output work which is related to the force applied on the propeller array (by the pressure differential) from the top of the hot column to the top of the cold column, the fluid velocity through it and the time (t).

In these dynamic conditions the ratio between $E_H$ and $E_C$ is maintained constant by the fact that the pressure on Cavity 4 from the hot column is in substance equal to the pressure on its other end from the cold column. This is true in good approximation when the fluid flow through cavity 4 is sufficiently slow and laminar and cavity 4 is sufficiently short. (Otherwise, the pressure differential between both ends of cavity 4 needs to be factored in)

In consideration of the above the following expression is implied:

$$\{(\gamma/(\gamma-1))p_C V+(\tfrac{1}{2})m_C\omega^2(r^2-h^2)+m_C U_C^2/2\}(1/V)=\{(\gamma/(\gamma-1))p_H V+(\tfrac{1}{2})m_H\omega^2(r^2-h^2)+m_H U_H^2/2\}(1/V) \quad 35.$$

Therefore:

$$(\gamma/(\gamma-1))p_C=(\gamma/(\gamma-1))p_H-(\tfrac{1}{2})\omega^2(r^2-h^2)(\rho_C-\rho_H)+(\rho_H U_H^2/2)(1-\rho_H/\rho_C) \quad 36.$$

Combining this with the expression (32) representing $E_{e(t)}$;

$$E_{e(t)}=U_H tA[(\gamma/(\gamma-1))p_H-(\rho_H/\rho_C)\{(\gamma/(\gamma-1))p_H-(1/2)\omega^2(r^2-h^2)(\rho_C-\rho_H)+(\rho_H U_H^2/2)(1-\rho_H/\rho_C)\}+(\rho_H U_H^2/2)(1-\rho_H^2/\rho_C^2)] \quad 37.$$

Note:

$$p_H v_H=m_{(t)}(R/M)T_H \quad 38.$$

Where $T_H$: is the absolute average temperature of the fluid in the hot column.

M: is the molar mass of the fluid in the system

And therefore 29, 37, 38:

$$E_{e(t)}=m_{(t)}(1-\rho_H/\rho_C)\{(\gamma/(\gamma-1))RT_H/M+(1/2)\omega^2(r^2-h^2)+U_H^2/2\} \quad 39.$$

Or, with 6,3

$$E_{e(t)}=m_{(t)}(1-\rho_H/\rho_C)\{(c_p/M)T_H+(1/2)\omega^2(r^2-h^2)+U_H^2/2\} \quad 40.$$

This expression, 39, quantifies in the context of the simplified standardized installation version, the value of electric energy (which includes the losses occurring outside of the system) which is output by the system as work done on the outside, in steady state. It is applicable to $\omega\neq 0$ angular frequency. Note that for low flow velocities the kinetic component becomes secondary (or even negligible) in its proportional contribution to the electric energy relative to the other energy components. In the above expressions the mass $m_{(t)}$ can be transferred into within the parentheses to be:

$$E_{e(t)}=(1-\rho_H/\rho_C)\{m_{(t)}(c_p/M)T_H+m_{(t)}(1/2)\omega^2(r^2-h^2)+m_{(t)}U_H^2/2\} \quad 41.$$

By changing the focal point of expression 41, the ratio between the hot column's density and the cold column's density imposed in consequence of the system's parameters and the output electric energy can be calculated:

$$(\rho_H/\rho_C)=[m_{(t)}\{(c_p/M)T_H+(1/2)\omega^2(r^2-h^2)+U_H^2/2\}-E_{e(t)}]/[m_{(t)}\{(c_p/M)T_H+(1/2)\omega^2(r^2-h^2)+U_H^2/2\}] \quad 42.$$

In consequence of this expression, 42, it is implied that any ongoing electric energy which is output by the system towards the outside environment will necessarily impose the following:

$$\rho_H<\rho_C \quad 43.$$

$$T_C<T_H \quad 44.$$

Where, $T_C$: absolute average temperature of the fluid in the cold column.

The System's Efficiency in Producing Output Work, $E_{e(t)}$

To calculate the efficiency of the system in producing work output through the propeller array, this efficiency needs to first be defined. Over every period of time, t, the system makes available the equivalent of:

$$\{m_{(t)}(c_p/M)T_H+M_{(t)}(1/2)\omega_2(r^2-h^2)+m_{(t)}U_H^2/2\} \quad 45.$$

And by the same process recuperates:

$$-(\rho_H/\rho_C)\{m_{(t)}(c_p/M)T_H+m_{(t)}(1/2)\omega^2(r^2-h^2)+m_{(t)}U_H^2/2\} \quad 46.$$

On the basis of the definition of this efficiency as being the ratio between the output energy $E_{e(t)}$ and the total energy made available as per expression 45, the efficiency can be expressed as follows:

$$\eta=E_{e(t)}/\{m_{(t)}(c_p/M)T_H+m_{(t)}(1/2)\omega^2(r^2-h^2)+m_{(t)}U_H^2/2\} \quad 47.$$

Therefore;

$$\eta=1-\rho_H/\rho_C \quad 48.$$

This establishes the criteria for the system's steady state and implies that in regular working process, the system will not be stable unless there is equilibrium between its work output efficiency $\eta$ and its densities ratio (taking in consideration its various working parameters such as dimensions, fluid pressure, hot/cold columns' fluids temperature differential, angular frequency, etc.). In addition, this continuity of the regular work process requires the heat transfer rate capacity from the environment into the system to be at least equal to the output energy, stabilizing at $Q_{T(t)}=E_{e(t)}$.

The Coriolis Force Effect and its Main Implications on Steady State of the Process The fluid, in the hot and cold columns flow in opposite directions parallel to the rotation radius. For steady fluid flow, the angular velocity of the molecules which flow away from the axis is increased as the radius is increased. The contrary happens to the molecules, flowing towards the axis. In steady state, over every period of time, t, the same mass, $m_{(t)}$, enters and exits each of the columns, therefore:

$$F_H=-2M_H U_H\omega \quad 49.$$

$$F_C=-2m_C U_C\omega=-2(\rho_C/\rho_H)m_H(\rho_H/\rho_C)U_H\omega=-2M_H U_H\omega \quad 50.$$

Where, $F_H$: the Coriolis force caused by the flow of the fluid in the hot column, in the rotating IR $F_C$: the Coriolis force caused by the flow of the fluid in the cold column, in the rotating IR Since in the hot and cold columns the flow directions are opposite, in the hot column the fluid flows toward the rotation axis and in the cold column, away from this axis. The overall effect of the Coriolis Forces on the rotation frequency is nil. This said, the fluid flowing in each of the columns will be unevenly pressed against the walls due to this force. This impacts the molecules' flow pattern along the columns and may cause added friction and turbulences. it is ignored as insignificant in the standardized installation (due to slow flow velocities). In addition, the Coriolis force may affect the flow pattern in Cavity 7 in consequence of unevenly cooled fluid—this also is ignored in the standardized version.

Compression and Decompression of Fluid in the Columns (—Additional Considerations)

The fluid in each of the columns, in rotating IR, steady process is subjected to different pressures at different distances from the rotation axis. These pressures influence the density of the gas state fluid at each rotation radius level. For every portion of mass, the internal distribution of the fluid energy between kinetic, potential and enthalpy shifts as it flows. Since the fluid in the cold column is continuously flowing "down" (away from the rotation axis), the molecules of the entire column are subjected to compression.

And, in the hot column:

Since the fluid in the hot column is continuously flowing "up" (towards the rotation axis), the molecules of the entire column are subjected to decompression. The compression, heating up the cold column's fluid (in well insulated, adiabatic process) and decompression, which is cooling the hot column's fluid, act against the system's design requirement of entering cavity 4 for reheating at the lowest possible temperature and having maximal temperature differential between the hot and cold columns' fluid.

In analysis of the impact of such compression on every mass m(t);

From the moment that it is exiting cavity 7 (and the propeller array) and entering the cold column at its top, Until the moment that it exits the cold column through its bottom, towards cavity 4, after time $t_c$, its energy, relative to the rotation axis, at the top and the bottom are:

$$E_{c(t)1}=m_{(t)}\{(\gamma/(\gamma-1))RT_{c1}/M+U_{c1}^2/2\} \quad 51.$$

$$E_{c(t)2}=m_{(t)}\{(\gamma/(\gamma-1))RT_{c2}/M-(\tfrac{1}{2})\omega^2r^2+U_{c2}^2/2\} \quad 52.$$

In conditions by which the mass, $m_{(t)}$ is well insulated and there is no additional input/output of energy with it, the overall energy of the mass at points of entry and exit, relative to the rotation axis remains unchanged.

$$E_{c(t)1}=E_{c(t)2} \quad 53.$$

$$m_{(t)}\{(\gamma/(\gamma-1))RT_{c1}/M+U_{c1}^2/2\}=m_{(t)}\{(\gamma/(\gamma-1))RT_{c2}/M-(\tfrac{1}{2})\omega^2r^2+U_{c2}^2/2\} \quad 54.$$

Also, since the mass is the same:

$$\rho_{c1}U_{c1}At=\rho_{c2}U_{c2}At \quad 55.$$

The temperature differential of this theoretical mass $m_{(t)}$ (flowing downward from top to bottom) over its total time present in the column $t_c$ (and provided it is at a temperature by which it is in gas state and far from the phase change temperature) is, therefore:

$$\Delta T_{mc(t)}=T_{c2}-T_{c1}=((\gamma-1)/\gamma)(M/R)\{(\tfrac{1}{2})\omega_2r^2+Uc_1^2/2(1-\rho_{c1}^2/\rho_{c2}^2)\} \quad 56.$$

Where:

Ec(t)1: Relevant energy of fluid of mass m(t) at the top of the cold column relative to the rotation axis consisting of enthalpy, potential energy, and directional kinetic energy.

Ec(t)2: Relevant energy of fluid of same mass m(t) at the bottom of the cold column relative to the rotation axis consisting of enthalpy, potential energy, and directional kinetic energy.

$T_{c1}$: The absolute temperature of the mass $m_{(t)}$ at its point of entry at the top of the cold column $T_{c2}$: The absolute temperature of the mass $m_{(t)}$ at its point of exit at the bottom of the cold column $\Delta T_{mc(t)}$: The temperature differential of the mass $m_{(t)}$ over its total time $t_c$ present in the cold column $t_c$: time period over which the mass $m_{(t)}$ is present in the cold column from moment of entry to moment of exit.

$\rho_{c1}$: mass $m_{(t)}$ density at point of entry.

$\rho_{c2}$: mass $m_{(t)}$ density at point of exit.

$Uc_1$: mass $m_{(t)}$ velocity at point of entry.

$Uc_2$: mass $m_{(t)}$ velocity at point of exit.

The same principle applies in reverse, dropping temperature, on the fluid in the hot column (in an adiabatic process) entering at the bottom and exiting at the top, after time $t_H$.

For the hot column:

At point of entry:

$$E_{H(t)1}=m_{(t)}\{(\gamma/(\gamma-1))RT_{H1}/M-(\tfrac{1}{2})\omega^2r^2+U_{H1}^2/2\} \quad 57.$$

At point of exit:

$$E_{H(t)2}=m_{(t)}\{(\gamma/(\gamma-1))RT_{H2}/M+U_{H2}^2/2\} \quad 58.$$

As in the hot column, in adiabatic conditions:

$$E_{H(t)1}=E_{H(t)2} \quad 59.$$

Therefore:

$$m_{(t)}\{(\gamma/(\gamma-1))RT_{H2}/M+U_{H2}^2/2\}=m_{(t)}\{(\gamma/(\gamma-1))RT_{H1}/M-(\tfrac{1}{2})\omega^2r^2+U_{H1}^2/2\} \quad 60.$$

Also, $$\rho_{H1}U_{H1}At=\rho_{H2}U_{H2}At \quad 61.$$

$$\Delta T_{mH(t)}=T_{H2}-T_{H1}=((\gamma-1)/\gamma)(M/R)\{(\tfrac{1}{2})\omega^2r^2+U_{H2}^2/2(1-\rho_{H2}^2/\rho_{H1}^2)\} \quad 62.$$

Where:

EH(t)1: Relevant energy of fluid of mass m(t) at the bottom of the hot column relative to the rotation axis (point of entry) consisting of enthalpy, potential energy, and directional kinetic energy.

$E_{H(t)2}$: Relevant energy of fluid of mass $m_{(t)}$ at the top of the hot column relative to the rotation axis (point of exit) consisting of Enthalpy, potential energy, and directional kinetic energy.

$T_{H1}$: The absolute temperature of the mass $m_{(t)}$ at its point of entry at the bottom of the hot column $T_{H2}$: The absolute temperature of the mass $m_{(t)}$ at its point of exit at the top of the hot column $\Delta T_{mH(t)}$: The temperature differential of the mass $m_{(t)}$ over its total time $t_H$ present in the hot column $t_H$: time period over which the mass $m_{(t)}$ is present in the hot column from moment of entry to moment of exit.

$\rho_{H1}$: mass $m_{(t)}$ density at point of entry.

$\rho_{H2}$: mass $m_{(t)}$ density at point of exit.

$U_{H1}$: mass $m_{(t)}$ velocity at point of entry.

$U_{H2}$: mass $m_{(t)}$ velocity at point of exit.

The compression/decompression effects may be minimized by low fluid flow velocity and also as follows:

The decompression cooling effect may be minimized by exposing the fluid in the hot column to additional heating from the environment also along the column including in sections which are closer to the rotation axis (reheating the progressively decompressing fluid). The reheating makes this portion of the process behave more like an isothermal decompression rather than adiabatic.

The compression heating effect may be minimized by setting the fluid temperature at entry point at the top of the cold column (after exiting the propeller array) to be very close to phase change (condensation) temperature, after the latent heat has in part been absorbed by the propeller array and output from the system. This allows the "downward" flow reheating to be attenuated as the fluid recuperates latent heat. In such context, the latent heat participating in the process is added to the other relevant fluid energy components and may be represented as follows:

$$Q_L=m_{(t)}L \quad 63.$$

Where:

$Q_L$: amount of energy released or absorbed during the change of phase of the fluid.

L: specific latent heat of the fluid.

In addition, the continuous mass portions are not isolated, in practice from each other along a column and there will therefore be heat flow within the column, mostly by radiation and convection thus impacting the internal temperature distribution. Slower the flow—longer the average energy exchange exposure time for each mass portion in the column (from entry to exit)—more flat the temperature differentials within each column. In addition, a mixture of fluids of different phase change temperatures may be used in the cavities so as to maintain gas behavior (in the portion of energy output through the propeller array) of one or more of the fluids in the mixture while benefiting of this phase change principle (condensation) in one or more of the other fluids.

The above described installation and process use a single source of thermal energy to convert a portion of it into useful energy.

That process assumes that the fluid entering cavity 6 (also named "the cold column") can be maintained at an original low temperature in a sustained manner, after every cycle of the fluid through the system.

It assumes that the fluid in cavity 5 (the hot column) will be sustained warmer than the fluid in the cold column as result of the thermal energy input from the warm surrounding environment, coupled with the fluid cooling effect caused by the energy output through the propeller array (in cavity 7) alone, without requiring a heat sink to evacuate excess thermal energy from the cold column to bring it back to its original low temperature before every cycle.

The inventor proposes an improvement and adjustment of the installation and process previously described so as to include a heat sink ensuring that the temperatures of the fluid portion in the hot column and the fluid portion in the cold column maintain their differential sustainably, over time.

In any and all events by which the energy output from the fluid, through its interaction with the propeller array, does not cool the fluid sufficiently to bring it back to its original given low temperature, the heat sink shall evacuate the excess heat from the fluid in the cold column to maintain the original conditions of temperature differentials which caused the flow and energy output to begin with.

Figure 10:
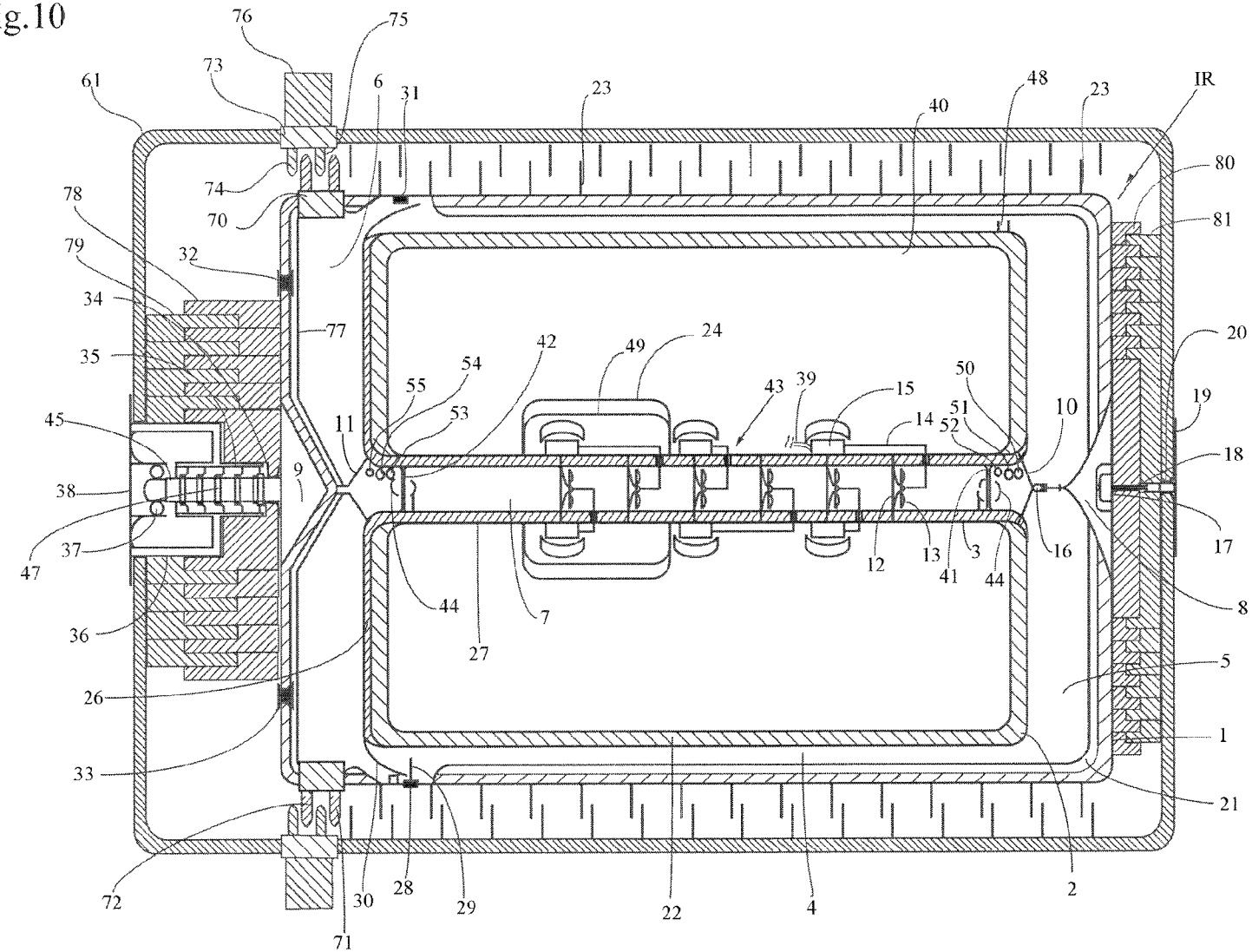
FIG. 10 is a cross axial section view of the inner rotor and outer shell of a second embodiment of the present invention.

The description of the adjustments to the installation previously described are the following (FIG. 10).

The outer cylinder 1, constituting the outer skin of the inner rotor IR, being a hollow, hermetically closed cylinder which is made of thermally conductive material, is provided with a ring shaped section layer of a thermally insulating material 70.

This ring shaped insulating layer 70, is hermetically attached to the outer cylinder 1's thermally conductive material, in a strong attachment able to withstand the vacuum conditions present in the cavity 60, between the outer cylinder 1, and the inside of the outer shell 61 against the pressure of the pressurized fluid inside the IR.

This ring shaped layer 70, is positioned near the closed base on the side of cavity 6 (the cold column) as part of the outer cylinder 1.

To this thermally insulating layer 70, are attached around its exterior two ring shaped flat surfaces 71, 72. These ring shaped attachments are made of also by thermally insulating material which is of color, reflective to electromagnetic heat radiation so as to reduce as much as possible heat from being radiated through these attachments 71, 72, in the space between the interior of outer shell 61, and outer cylinder, 1 (which is kept in vacuum conditions). This is to attenuate as much as possible heat transfer between the space exposed to the warmer environment area (hereinafter also "warmer environment") to the space exposed to the colder environment area (hereinafter also "colder environment"), on both sides of 71, 72, thus reducing undesired reheating of the fluid portion present in cavity 6 (the cold column).

The outer shell 61, is adjusted in a similar manner to outer cylinder 1, providing an annular section of its thermally conductive material, all around it, with a thermally insulating material layer 73, which is of same shape as the section and is attached to the outer shell 61, in a strong hermetic manner, able to withstand the outside environments' pressure against the vacuum conditions present inside the outer shell 61, in cavity 60.

The thermally insulating layer 73, is facing and is parallel to the counterpart insulating material layer 70, on outer cylinder 1.

To this section 73, on the interior side of outer shell 61, are attached two thermally insulating ring like flat surfaces (all along section 73) 74, 75, which are made of thermally insulating material and are also of color reflective to thermally radiation (as are the sections 73 and 70). These attachments have the same role as attachments 71, 72 and act together with them to further reduce heat transfer.

There are no heat exchange fins on the insulating sections 70, 73 or on any of their thermally insulating attachments.

To the thermally insulating layer 73, along it, on its exterior, is attached a thermally insulating section 76. This section has the purpose of separating between the warmer and colder environments to which the installation is exposed, outside the outer shell 61. The installation is exposed to these two environments as follows: all the space around the outer shell 61, from section 76 onward, outside where are situated cavities 4 and 5, is exposed to the warmer environment. All the space around the outer shell, 61, from section 76 onward, towards the other side, outside cavity 6, is exposed to a colder environment (which is colder than the warmer environment).

The thermally insulating layer 25 (FIG. 1) situated between cavity 6 and outer cylinder 1's base, is taken out to allow the cooling of the fluid portion in cavity 6 (the cold column) through its thermal exposure to the colder environment outside outer shell, 1, via the vacuum in the corresponding portion of cavity 60.

To improve such cooling a number of thermally conductive heat exchange fins 77, are attached in a thermally conductive manner to the interior of the base of outer cylinder 1, inside cavity 6. The direction of these heat exchange fins 77, is such that follows the flow pattern of the fluid inside cavity 6, for minimal disruption and turbulence.

On the outer surfaces of the bases of outer cylinder 1, and on the inner surfaces of the corresponding walls (or bases, if outer shell 61, is cylinder shaped) of outer shell 61, a number of circular thermally conductive heat exchange fins are attached in a thermally conductive manner at variable radiuses around the rotation axis: fins 78, 79 and fins 80, 81, respectively. Fins 78, 79, allow for the increase of the heat radiation area inside the vacuum cavity 60, thus improving the rate of cooling of the fluid inside cavity 6, by the outside colder environment. Fins 80, 81, allow for the increase of the heat radiation area inside the vacuum cavity 60, thus improving the rate of heating of the fluid inside cavity 5, by the outside warmer environment. The circular shape of the fins and varying radiuses allow the corresponding fins 78, 79 and 80, 81 to continuously face each other without disruption while the inner rotor rotates inside the outer shell, 61.

The process implementing the improved installation is described below:

After the motor 17 is activated, rotating the inner rotor IR to a desired rotation angular frequency $\omega$ while the outer shell OS is kept within the same cold environment until the temperature stabilizes under rotation conditions, the installation's outer shell 61, is exposed to a work environment of two different temperatures areas, separated by the thermally insulating section 76. The fluid portion inside cavities 4, and 5, in gas state, is exposed to a warmer (relative to the colder environment area) environment area present outside the outer shell 61, around them. The fluid portion, inside cavity 6, in gas state (may also be in liquid state), is exposed to a colder (relative to the warmer environment area) environment area present outside the outer shell 61, facing it. Since the fluid in the cavities and the outside environment areas are separated by thermally conductive material and vacuum, the heat exchange between the fluid portions in the cavities and their respective environment areas occurs through convection (in the fluid), conduction (in the thermally conductive skin and fins' material) and radiation (through cavity 60, in vacuum)

and by combinations thereof. The thermally insulating sections 70, 73, and respective insulating attachments 71, 72 and 74, 75, 76 attenuate to a minimum temperature interference and heating influences between the two areas of environment, their respective cavities inside the inner rotor and the fluid portions in them.

In consequence of the two environment areas the fluid which is pressurized inside the inner rotor's cavities is of variable temperature: the fluid inside cavities 4, 5 is warmer than the fluid portion inside cavity 6. For this reason, before the centrifuge motor 17, is activated, the density of the gas state fluid is higher in the cavities in which it is of lower temperature. The fluid portion in cavity 6, the cold column, is denser, and therefore of higher mass per volume than the warmer fluid portion in cavity 5, the hot column (note: columns being of same volume in the standardized version). Upon the activation of the centrifuge motor, 17, to a given rotation rate, the fluid portions in the hot and cold columns are subjected to centripetal forces consequence of their mass and rotation rate and present counter pressure on each other, through their bottom, via cavity 4.

The colder, higher mass fluid portion in the cold column, seeks to advance against the lower mass, warmer fluid portion in the hot column to equilibrate the pressure on both ends of cavity 4. In consequence of this advance, the pressure at the end of cavity 7, attached to the top of the cold column drops in respect to the pressure at the other end of this cavity 7, on its other end, attached to the top of the hot column. This pressure differential causes the advance of the fluid through cavity 7, through the propellers 13, of the propeller array, actuating them, resulting in the output of electric or other useful energy, outside the system. This energy output is a portion of the fluid's intermolecular kinetic energy (in fact, proportional to a corresponding fluid's temperature) and results in the cooling of the fluid as it advances through cavity 7, towards the top of the cold column. This freshly arriving fluid into the cold column is cooler in respect to its temperature at its point of entrance to cavity 7, at the top of the hot column. The colder environment area outside the cold column, allows the fluid temperature in the cold column to be further reduced, loosing heat to this colder environment area. At equilibrium conditions the temperature differential between the fluid portions in the hot and cold columns, consequence of the temperature differential between the colder and warmer environment areas, combined with the centrifuge conditions caused by the rotation of the inner rotor, allow a sustained fluid flow through the cavities 7, 6, 4, 5 and sustained useful energy output. This process has as a consequence a cooling effect on the warmer environment area and heating effect on the colder environment area. The pressure level of the fluid inside the inner rotor's cavities, centrifuge motor 17's rotation rate and resistance levels of the output electric circuits (and in consequence, resistance to flow levels of each corresponding rotor 13) need to be adjusted to optimize the energy recuperation from any two environment areas parameters. The energy recuperated through this process is a portion of the thermal energy differential between the two environment areas to which the outer shell 61 is exposed.

The thermal energy generated by the losses of the centrifuge motor 17, and the output generators, 15 and their mechanisms' friction is channeled back and recuperated to a significant extent in the warmer fluid through cavities 4 and 5. The turbulence and friction caused by the residual gas in cavity 60 (which is designated to be in, as much as possible, vacuum conditions) contributes to the heating action of the warmer environment area and disrupts the cooling action of the colder environment area and needs to be minimized by optimizing the vacuum and making the shape of the exterior of outer cylinder 1, interior of outer shell 61, and their attachments, as aerodynamic as possible. The energy required to create the rotation by the centrifuge motor 17 (after loss heat recuperated through the warmer fluid is deducted) is the minimal required useful output so as to have an overall useful output, which is greater than zero.

Sources for hot and cold environment areas and means of collection:

The sources of hot and cold external environment areas which are in close physical proximity are many. By way of example, hereafter the description of some options for environment areas and means of collection: using two separate thermally conductive pipelines/fins for maximal heat exchange capacities, one for the colder environment area and another for the warmer environment area, with or without having each contain a fluid (liquid or gas state) which is circulated by means of an in-line pump. One set, evacuating heat from the fluid portion requiring cooling, to the colder environment area and the other, collecting heat from the warmer environment area towards the fluid portion requiring heating.

Circumstances of already moving heat exchange surfaces may be used, such as moving vessel at sea; aircraft in air etc. windy conditions also increase the exchange capacities of such surfaces.

As combined hot/cold sources may be used temperature differentials between, for example, the following combinations: deeper and surface see level, sea and air, underground temperature and atmospheric air, higher and lower air, sunny side and shaded side, dry air and sprayed water (or other liquid) cooling effect by evaporation (useful mainly in environments which are with low humidity). Other combined sources may use temperature differentials between loss sourced heating (such as any electric/electronic appliance, power plants generators, vehicle engines etc.) coupled with nearby environmental air/water serving as the colder environment area. Active sources of warmer environment area are also possible, burning fuel to generate the required heat source, thus making this installation act as a thermally efficient generator. Also, a portion of the useful energy produced by the system may be feedback, if so chosen to contribute to the cooling of the cold environment area and/or the heating of the warm environment area.

Figure 11:
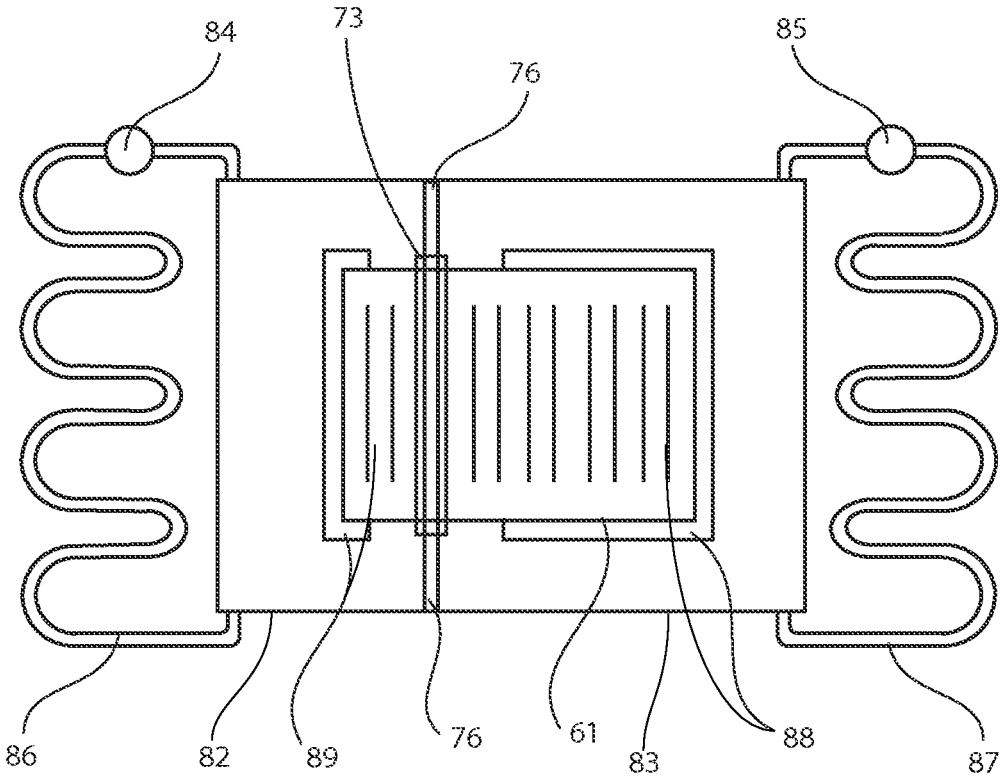
FIG. 11 depicts a schematic example of practical connection to the colder/warmer environments areas.

FIG. 11 depicts a schematic example of practical connection to the colder/warmer environments areas: the outer shell, 61's, thermally conductive exterior is split by the thermally insulating layer 76. On the two thermally conductive parts are attached thermally conductive heat exchange fins 88, 89. These two parts of the outer shell 61, are fitted with hermetic, thermally insulating covers 82, 83, which are attached onto thermally insulating section 76, hermetically. To each of these covers 82, 83, is attached hermetically a thermally conductive pipeline, 86, 87, respectively. Each of these pipelines, 86, 87, contains a thermal fluid and is fitted with a pump, 84, 85, respectively. The pumps circulate the fluid between the outer shell, 61' exterior and the sources of hot/cold temperatures which constitute the two environment areas required for the process.

Among additional consequences/results of the process and installation, depending on the configuration chosen, are cooling, condensation, and motion generation. The process and installation may participate directly and/or indirectly in a variety of processes and installations and for a wide range of uses. Some of which exist at the time of presentation and others which will be made feasible as a consequence.

The invention claimed is:

1. Installation designed to convert thermal energy available in a given work environment into useful energy wherein it comprises:

A hermetically sealed outer shell (OS) provided with a two-way valve housing an inner closed cylindrical rotor (IR) separated from the outer shell (OS) by a vacuum cavity and supported by the outer shell in two support surfaces, the inner rotor (IR) is made of three hollow cylindrical parts made by a thermally conductive material, one inside the other fixed to each other around their common rotation axis, the first part is an outer hollow cylinder closed by two end base walls housing the second part which is a smaller middle cylinder and the third part which is an inner cylinder formed inside the middle cylinder around the common rotation axis, in that the inner cylinder is open at its axial ends and provided with two controlled seals allowing to close or open a first cavity formed inside the inner cylinder, in that the middle cylinder is closed by two end base walls around the inner cylinder forming a second cavity, in that the inner cylinder, one of the end base walls of the middle cylinder and the opposed one of the outer hollow cylinder are provided with an thermally insulating layer, in that the periphery of the end of the middle cylinder provided with the thermally insulating layer is provided with a controlled array of valves or a controlled skirt seal allowing to hermetically separate in two parts a third cavity formed between the base walls of the middle and outer hollow cylinders and open or close a passage between the said two parts of the third cavity, in that the outer hollow cylinder is provided with a one-way valve and a two-way valve, in that an array of propellers is provided inside the inner cylinder equipped with shafts connected to energy conversion means enabled to convert, the rotational energy of the propellers into useful energy, in that a motor is located inside the outer shell (OS) driving in rotation the inner rotor (IR), in that power and data transmission means are provided to control the motor, the propellers, the seals, to transmit outside the installation the converted rotational energy of the propellers to monitor temperature and pressure inside the inner rotor (IR) and in that a pressurized fluid is located inside the inner rotor (IR).

2. Installation according to claim 1, wherein the external lateral surface of the outer hollow cylinder is provided with circular heat exchange fins, in that internal surface of the outer hollow cylinder is provided with heat exchange fins which are perpendicular to its surface and parallel to its axis and converge toward the rotation axis.

3. Installation according to claim 2, wherein, the propellers are equipped with means converting the rotational energy into electrical energy.

4. Installation according to claim 2, wherein the outer hollow cylinder is provided with a ring shaped section layer of a thermally insulating material-positioned near the closed base on the side of the third cavity as part of the outer hollow cylinder, two ring shaped flat surfaces of thermally insulating material are attached around the exterior of the ring shaped section layer, the outer shell, provided with a thermally insulating material annular layer facing and parallel to the counterpart insulating material layer, on outer hollow cylinder, on the interior side of outer shell area provided with said thermally insulating material annular layer are attached two thermally insulating ring like flat surfaces, a thermally insulating section is attached on the exterior of said thermally insulating material annular layer, the end base walls of the outer hollow cylinder are not provided with a thermally insulating layer, several thermally conductive heat exchange fins are attached in a thermally conductive manner to the interior of the base of outer hollow cylinder, several thermally conductive heat exchange fins are attached in a thermally conductive manner at variable radiuses around both ends of the rotation axis situated inside the outer shell (OS).

5. Process implementing the installation according to claim 2 for converting thermal energy available in a given work environment into useful energy by the following steps:

pressurizing a fluid into the vacuum cavity formed between the outer shell (OS) and inner rotor (IR) the fluid passing through the no-return valve of the outer hollow cylinder, into the cavities of the inner rotor (IR);

after the filling with a homogenously pressurized fluid of all the cavities of the inner rotor (IR) is achieved, dropping the fluid pressure around the inner rotor (IR) to cause no-return valve of outer hollow cylinder to lock;

evacuating the fluid from the vacuum cavity between the outer shell (OS) and the inner rotor (IR) by pumping the fluid out, to reach almost absolute vacuum conditions;

placing the outer shell (OS) in a cooled environment;

once a desired cold temperature is reached throughout the inner rotor (IR), hermetically closing the seal situated at the end of the inner cylinder close to the walls provided with the insulating layer while the seal situated at the other end of the inner cylinder and the array of valves or seal skirt are closed to allow flow of fluid to equalize pressures:

activating the motor is activated, rotating the inner rotor (IR) at a desired rotation angular frequency ($\omega$) while the outer shell (OS) is kept within the cooled environment until the temperature throughout the inner rotor (IR) stabilizes while the inner rotor is rotating;

placing the outer shell (OS) in a work environment which is of higher temperature than the cooled environment to cause the temperatures inside the inner rotors cavities to rise due to the radiation emitted by the environmental thermal energy, received from the outer shell (OS) through the vacuum cavity and the heat exchange fins of the outer hollow cylinder and the temperature of the insulated areas rise less than the temperatures of the non-insulated areas;

monitoring temperatures of the insulated and non-insulted sections, adjusting an exposed time in the work environment to reach maximal differential temperature between warmer and colder areas to cause corresponding density differences between the fluid in the respective warmer and colder areas, coupled with centrifuge conditions to which the fluid is subjected rotation of the inner rotor, generate pressure differentials between the warmer and colder areas to cause the flow of fluid from high to low pressure areas seeking pressure equilibrium;

once the fluid flow stops and the fluid in the cavities is at practical rest conditions, opening the seals at the ends of the inner cylinder and the array of valves or the seal skirt, causing due to pressure differentials the flow of fluid from the warmer areas to colder areas inside the inner cylinder, the fluid flow activates the propellers of which rotational energy is converted into a useful energy and causes the cooling of the fluid which continues to flow towards the part of the inner rotor (IR) provided with insulating layer and containing colder fluid;

the colder fluid thereafter continues to flow through the array of valves or the seal skirt towards the non-insulated areas of the inner rotor (IR) where the temperature of the colder fluid is raised by environmental thermal energy.

6. Installation according to claim 1, wherein the outer hollow cylinder is provided with a ring shaped section layer of a thermally insulating material positioned near the closed base on the side of the third cavity as part of the outer hollow cylinder, two ring shaped flat surfaces of thermally insulating material are attached around the exterior of the ring shaped section layer, the outer shell, provided with a thermally insulating material annular layer facing and parallel to the counterpart insulating material layer, on outer hollow cylinder, on the interior side of outer shell area provided with said thermally insulating material annular layer are attached two thermally insulating ring like flat surfaces, a thermally insulating section is attached on the exterior of said thermally insulating material annular layer, the end base walls of the outer hollow cylinder are not provided with a thermally insulating layer, several thermally conductive heat exchange fins, are attached in a thermally conductive manner to the interior of the base of outer hollow cylinder, several thermally conductive heat exchange fins are attached in a thermally conductive manner at variable radiuses around both ends of the rotation axis situated inside the outer shell (OS).

7. Process implementing the installation according to claim 1 for converting thermal energy available in a given work environment into useful energy by the following steps:

pressurizing a fluid into the vacuum cavity formed between the outer shell (OS) and inner rotor (IR) the fluid passing through a no-return valve of the outer hollow cylinder, into the cavities of the inner rotor (IR);

after the filling with a homogenously pressurized fluid of all the cavities of the inner rotor (IR) is achieved, dropping the fluid pressure around the inner rotor (IR) to cause no-return valve of outer hollow cylinder to lock;

evacuating the fluid from the vacuum cavity between the outer shell (OS) and the inner rotor (IR) by pumping the fluid out, to reach almost absolute vacuum conditions;

placing the outer shell (OS) in a cooled environment;

once a desired cold temperature is reached throughout the inner rotor (IR), hermetically closing the seal situated at the end of the inner cylinder close to the walls provided with the insulating layer while the seal situated at the other end of the inner cylinder and the array of valves or seal skirt is closed to allow flow of fluid to equalize pressures;

activating the motor to rotate the inner rotor (IR) at a desired rotation angular frequency (ω) while the outer shell (OS) is kept within the cooled environment until the temperature throughout the inner rotor (IR) stabilizes while the inner rotor is rotating;

placing the outer shell (OS) in a work environment which is of higher temperature than the cooled environment to cause the temperature inside cavities of the inner rotor to rise due to the radiation emitted by the environmental thermal energy, received from the outer shell (OS) through the vacuum cavity and the heat exchange fins of the outer hollow cylinder and the temperature of the insulated areas rise much less than the temperatures of the non-insulated areas;

the monitoring temperatures of the insulated and non-insulated sections, adjusting an exposure time in the work environment to reach maximal differential temperature between warmer and colder areas to cause a corresponding density difference between the fluid in the respective warmer and colder areas, coupled with the centrifuge conditions to which the fluid is subjected by the rotation of the inner rotor, generate pressure differentials between the warmer and colder areas to cause the flow of the fluid from high to low pressure areas seeking pressure equilibrium;

once the fluid flow stops and the fluid in the cavities is at practical rest conditions opening the seals at the ends of the inner cylinder and the array of valves or the seal skirt, causing due to pressure differentials the flow of fluid from the warmer areas to colder areas inside the inner cylinder, the fluid flow activates the propellers of which rotational energy is converted into a useful energy and causes the cooling of the fluid which continues to flow towards the part of the inner rotor (IR) provided with insulating layer and containing the colder fluid;

the colder fluid thereafter continues to flow through the array of valves or the seal skirt towards the non-insulated areas of the inner rotor (IR) where the temperature of the colder fluid is raised by environmental thermal energy.

8. Process according to claim 7 implementing the installation according to claim 6, wherein:

after the motor is activated, rotating the inner rotor (IR) at the desired rotation angular frequency (ω) while the outer shell (OS) is optionally kept within the cooled environment until the temperature throughout the inner rotor stabilizes while the inner rotor is rotating, the outer shell (OS) is placed in a work environment of two different temperatures areas producing useful energy.

9. Process according to claim 8 wherein the said fluid inside cavities of the inner rotor is brought to a temperature by which the fluid is close to phase change (condensation) by the energy output of the installation to attenuate heating and cooling effects related to compression and decompression taking place in warmer and colder areas of the inner rotor (IR).

10. Process according to claim 7, wherein the fluid inside cavities in the inner rotor is brought to a temperature by which the fluid is close to phase change (condensation) by the energy output of the installation to attenuate heating and cooling effects related to compression and decompression taking place in warmer and colder areas of the inner rotor (IR).

11. Process according to claim 10, wherein a mix of different fluids is used instead of monotype fluid, such that at a particular fluid mixture temperature one or more fluids maintain a gas state behavior after the energy output in the area inside the inner cylinder, while one or more other fluids condensate thus improving the capacity of the fluid mixture to take advantage of phase change latent energy absorption and release to further counteract heating and cooling effects related to compression and decompression taking place in the installation in warmer and colder areas.

* * * * *